US008071902B2

(12) United States Patent
Ichikawa et al.

(10) Patent No.: US 8,071,902 B2
(45) Date of Patent: Dec. 6, 2011

(54) PUSH-BUTTON SWITCH AND ELECTRONIC APPARATUS HAVING THE SAME

(75) Inventors: Yohei Ichikawa, Kanagawa (JP); Kiyoshi Nakanishi, Kanagawa (JP)

(73) Assignee: Panasonic Corporation, Osaka (JP)

( * ) Notice: Subject to any disclaimer, the term of this patent is extended or adjusted under 35 U.S.C. 154(b) by 790 days.

(21) Appl. No.: 12/158,163

(22) PCT Filed: Jun. 6, 2006

(86) PCT No.: PCT/JP2006/311309
§ 371 (c)(1),
(2), (4) Date: Jun. 19, 2008

(87) PCT Pub. No.: WO2007/074547
PCT Pub. Date: Jul. 5, 2007

(65) Prior Publication Data

US 2009/0090607 A1 Apr. 9, 2009

(30) Foreign Application Priority Data

Dec. 27, 2005 (JP) ..... 2005/023881

(51) Int. Cl.
*H01H 13/14* (2006.01)
*H01H 3/12* (2006.01)

(52) U.S. Cl. ..... 200/341; 200/5 A; 200/512

(58) Field of Classification Search ..... 200/341
See application file for complete search history.

(56) References Cited

U.S. PATENT DOCUMENTS 5,986,228 A 11/1999 Okamoto et al.
6,982,394 B2 * 1/2006 Ide et al. ..... 200/516

FOREIGN PATENT DOCUMENTS

JP 63-087730 U 6/1988
JP 11-232963 A 8/1999
JP 2000-311050 A 11/2000

OTHER PUBLICATIONS

European Search Report dated May 20, 2009.

* cited by examiner

*Primary Examiner* — Renee Luebke
*Assistant Examiner* — Lheiren Mae A Caroc
(74) *Attorney, Agent, or Firm* — Pearne & Gould LLP

(57) ABSTRACT

To prevent the local heating of an electronic apparatus chassis, there is provided a push button switch (10), which comprises a substrate (11) having a first contacting part (11*a*) and a second contacting part (11*b*) operable to be brought into electrical conduction with the first contacting part (11*a*), and a flexible electrically insulating sheet (13) covering the substrate (11) and having a click portion (13*a*) on the inside of which the first and second contacting parts are disposed to be brought into and out of electrical conduction therebetween in response to depression of the click portion. The electrically insulating sheet (13) includes a heat conducting layer (14) extending along the substrate (11).

12 Claims, 17 Drawing Sheets

PUSH-BUTTON SWITCH AND ELECTRONIC APPARATUS HAVING THE SAME

TECHNICAL FIELD

The present invention relates to a push button switch and an electronic apparatus having the same, and more particularly to a push button switch improved in heat soak and heat radiation characteristics to be proper for portable electronic apparatuses, and an electronic apparatus having the improved push button switch.

BACKGROUND ART

Recently it has been strictly required that electronic apparatuses, especially portable electronic apparatuses are reduced in volume and body thickness and multi-functionalized, and that each of the portable electronic apparatuses includes in its chassis/body a high density mounted substrate having a plurality of electronic parts but improved in efficiency of heat radiation from the mounted electronic parts.

One of the electronic apparatuses of such type is shown in FIGS. 15-17 as a mobile phone. (See, for example, Patent Document 1 listed below.) As shown in FIG. 15, this electronic apparatus 10 comprises a lower side body 101 including an operation input portion 102 and a voice input portion 103, an upper body 105 including an display panel 106 and a voice output portion 107, and a hinge portion 104 connecting the lower body 101 and the upper body 105 to be able to assume their fold-open and fold-closed positions. The lower side body 101 is constituted by an operational side chassis 101*a* and a backside chassis 101*b*. As shown in FIG. 16, the lower side body 101 is provided therein with a substrate 121 designed for performing communication process and input and output control, a key sheet 122 having an elastic sheet portion 122*a* and a plurality of key tops 122*b*, 122*c*, 122*d* mounted on the sheet portion 122*a*, and a flexible electrically insulating sheet 123. These constitute a plurality of push button switches 110 operative to be switched in switching state between connected and disconnected in response to depression of the key tops 122*b*, 122*c*, 122*d*(See FIG. 17).

To put it in concrete, the electrically insulating sheet 123 is shown in FIG. 17 by a sectional view. The electrically insulating sheet 123 of embossed key and click type has a set of embossed key portions 123*a* respectively positioned below the key tops 122*b*. Each of the embossed key portions 123*a* is provided on its sphere concave side with a movable contact 126 made of metal spring material and having an arcuate section. In addition, the substrate 121 is provided on its upper side with stationary contacting parts 121*a*, 121*b* each facing to the movable contact 126.

On the other hand, the substrate 121 is provided on its underside with a heat generating part 129 such as for example a known power amplifier or the like, while, each of the key tops 122*b* of the key sheet 122 is provided on its surface portion with a heat radiating layer, not shown clearly in the drawings, mainly made of aluminum and a decorative layer laminated on the surface of the heat radiating layer so as to facilitate heat radiation through the key top 122*b*.

[Patent Document 1] JP, 2004-311332, A (Japanese Patent Application Publication No. 2004-311332)

DISCLOSURE OF INVENTION

Problem to be Solved

The electronic apparatus comprising the aforementioned push button switches, however, encounters the difficulties in increasing efficiency of heat soak of the chassis or body including the substrate 121 having the heat generating part 129 mounted thereon due to the fact that the respective heat radiating layers of the key tops 122*b* of the key sheet 122 are separate and independent from one another.

For this reasons, it is difficult to assuredly prevent the chassis of the electronic apparatus from being heated partly to high temperature.

Furthermore, the heat radiating layers are distant from the heat generating part 129 mounted on the substrate 121, and a certain number of layers having high thermal conductivity intervene between the heat radiating layers and the heat generating part 129. These also make it difficult to increase the efficiency of heat radiation through the heat radiating layers in order to decrease the temperature of the heat generating part 129 and other surrounding parts mounted in the vicinity of the heat generating part 129.

The present invention has been made to solve such the drawbacks of the prior art. It is therefore an object of the present invention to provide an electronic apparatus capable of preventing the local heating of its chassis due to the high temperature rise of the heat generating part and other surrounding parts.

Means for Solving Problems

In order to achieve the object, as an aspect of the present invention, there is provided a push button switch, comprising a substrate having a first contacting part and a second contacting part operable to be brought into electrical conduction with the first contacting part, and a flexible electrically insulating layer covering the substrate and having a click portion. The first contacting part and the second contacting part are disposed on the inside of the click portion so as to be brought into and out of electrical conduction there between in response to depression of the click portion of the electrically insulating layer. In this apparatus, the electrically insulating layer includes a heat conducting layer extending along the substrate.

According to the present construction, the substrate can be efficiently heat soaked in every surface direction along the surface of the substrate by the heat conducting layer extending along the substrate. The heat conducting layer positioned in the vicinity of the surface of the substrate and extending along the surface of the substrate enables to broadly diffuse heat from a certain heat generating part on the substrate in the surface direction to increase efficiency of radiation of the heat.

Incidentally, it goes without saying that the heat conducting layer is a part or member forming part of the electrically insulating layer having thermal conductivity higher than that of the remaining part or member of the electrically insulating layer.

In the push button switch according to the present invention, the electrically insulating layer preferably includes an upper insulating cover layer positioned on one side of the heat conducting layer against the substrate, and a lower insulating cover layer positioned on the other side of the heat conducting layer with the substrate, the upper insulating cover layer and the lower insulating cover layer being tacked to each other so as to cover and surround the contour of the heat conducting layer. This construction makes it possible to produce a superiorly heat-conductive electrically insulating layer, which is constituted by the upper and lower insulating cover layers and the heat conducting layer interposed between the upper and lower insulating cover layers.

Desirably, the electrically insulating layer includes an insulating cover layer extending along the substrate and securely adhered onto the heat conducting layer. According to the present construction, if only the heat conducting layer is disposed within an area favorable for heat soak, the heat radiation becomes more effective and the heat conducting layer can be so laminated on the substrate as to be close to the substrate at the same time when the electrically insulating layer is attached to the substrate.

In the push button switch according to the present invention, the heat conducting layer may have an opening portion corresponding to the click portion of the electrically insulating layer. According to the present construction, the height of the click portion of the electrically insulating layer on the substrate can be reduced, and the push button switch can be reduced in volume and thickness and improved in click feeling.

In the push button switch according to the present invention, the opening portion of the heat conducting layer may be positioned within a depression area over which the depression force to the click portion of the electrically insulating layer may be exerted. According to the present construction, the height of the click portion of the electrically insulating layer on the substrate can be substantially reduced, and the push button switch can be reduced in volume and thickness with the heat soak effect sufficiently increased by means of the heat conducting layer.

In the push button switch according to the present invention, the inner edge of the opening portion of the heat conducting layer may be superimposed on the outer edge of the click portion of the electrically insulating layer or encircle the outer edge of the click portion of the electrically insulating layer.

Further, the electrically insulating layer may include an upper insulating cover layer positioned on one side of the heat conducting layer against the substrate and a lower insulating cover layer positioned on the other side of the heat conducting layer with the substrate, either one of which has another opening portion on the click portion of the electrically insulating layer. According to the present construction, the height of the click portion of the electrically insulating layer can be reduced with sufficient insulating ability. In addition, if the lower insulating cover layer is exposed to the outside within the area of the click portion and the heat conducting layer is electrically conductive, the contacting parts on the substrate can be prevented from being brought into electrical conduction with the heat conducting layer. On the other hand, if the upper insulating cover layer is exposed to the outside within the area of the click portion, the electrically insulating layer can be certainly prevented from being come off.

In the push button switch according to the present invention, it is preferred that the heat conducting layer be made of graphite. This construction makes it possible to remarkably increase effect of heat soak in the surface direction of the substrate and adequately suppress the rise of temperature of the heat generating part and other surrounding parts.

In the push button switch according to the present invention, it is also preferred that the substrate include an electrically conductive layer, and the heat conducting layer be made up of an electrically conductive material and electrically connected with the electrically conductive layer of the substrate. According to the present construction, the substrate can be prevented from being affected by the static electricity and from causing an erroneous operation due to the static electricity.

In the push button switch according to the present invention, it is further preferred that the electrically insulating layer have a white or glossy surface course. According to the present construction, the white or glossy surface course of the electrically insulating layer can be an optical guide through which light emitted from a light source is guided to a certain illumination area. This enables to illuminate the illumination area with uniform intensity and color of the illumination. Here, the electrically insulating layer may partly have a white or glossy portion as its surface course or may be formed in whole by white or glossy material.

In addition to the first and second contacting parts on the substrate, the push button switch according to the present invention may comprise a flexible third contacting part disposed on the inside of the click portion and operable to bring the first and second contacting parts into electrical connection when the click portion of the electrically insulating layer is depressed to bring the third contacting part into contact with the first and second contacting parts. In this case, the flexible third contract may be composed of an electrically conductive plate spring formed in an arcuate section and extending along the inside surface of the click portion. The plate spring can improve endurance of the push button switch and produce a switch depression feeling such as the click feeling. The above electrically insulating layer may be constituted by an insulating retainer layer retaining the third contacting part and securely adhered onto the substrate, a heat conducting layer securely adhered onto the insulating retainer layer, and an insulating cover layer securely adhered onto the heat conducting layer to protect the heat conducting layer. This enables to provide in the electrically insulating layer a heat conducting layer to have high thermal conductivity with a preferable insulating ability of the electrically insulating layer. The thicknesses of the insulating retainer layer, the heat conducting layer and the insulating cover layer may be partly respectively reduced within the depression area of the click portion. Otherwise, at least the heat conducting layer of upper two layers consisting of the heat conducting layer and the insulating cover layer may have an opening portion corresponding to the click portion of the electrically insulating layer. The inner edge of the opening portion may be formed in a shape the same as or similar to the contour of the click portion. The shape may also be an arbitral shape different from the contour of the click portion.

In order to achieve the above object, as another aspect of the present invention, there is provided an electronic apparatus, comprising any one of the aforementioned push button switches. According to the present construction, the substrate with many electronic parts can be more efficiently heat soaked in an arbitrary direction along the surface of the substrate by the heat conducting layer extending along the substrate. The heat conducting layer positioned in the vicinity of the surface of the substrate and extending in a direction parallel to the surface of the substrate enables to broadly diffuse heat from the heat generating part and the like on the substrate in the surface direction of the substrate so as to increase efficiency of radiation of the heat. Consequently, it becomes possible to effectively suppress the temperature of the heat generating part and other surrounding parts and prevent the chassis of the electronic apparatus from being heated partly to high surface temperature.

EFFECTS OF INVENTION

According to the push button switch of the present invention, effect of heat soak of the substrate can be increased by sufficient heat radiation along the surface of the substrate through the heat conducting layer extending along the substrate. In addition, it becomes possible to broadly diffuse heat from the heat generating part on the substrate along the surface of the substrate by means of the heat conducting layer in the vicinity of the substrate.

According to the electronic apparatus of the present invention, the substrate with many mounted electronic parts can be more efficiently heat soaked in every direction along the surface of the substrate by the heat conducting layer extending along the substrate. The heat conducting layer positioned in the vicinity of the surface of the substrate enables to broadly diffuse heat from the heat generating part and the like on the substrate in every direction along the surface of the substrate so as to remarkably increase efficiency of radiation of the heat. Consequently, it becomes possible to provide an electronic apparatus capable of preventing the local heating of its chassis resulting from the high temperature rise of the heat generating part and other surrounding parts.

Furthermore, it is also possible to reduce the thickness of the electronic apparatus and improve the click feeling and the like of the push button switch in the case that the heat conducting layer has an opening portion corresponding to the click portion of the electrically insulating layer.

BRIEF EXPLANATION OF DRAWINGS

The features and advantages of the present invention will more clearly be understood from the following description taken in conjunction with the accompanying drawings in which.

EXPLANATION OF LETTERS AND NUMERALS

1 mobile phone (electronic apparatus)
10, 20, 30, 40, 50 push button switch
11, 51 printed circuit substrate (substrate)
11*a*, 51*a* first contacting part
11*b*, 51*b* second contacting part
12 third contacting part
12*c* center portion (movable contact)
13, 23, 33, 43, 53 electrically insulating sheet (electrically insulating layer)

13*a*, 23*a*, 33*a*, 43*a*, 53*a* click portion
14, 24, 34, 44, 54 heat conducting layer
14*e* peripheral edge portion
15*a*, 25*a*, 35*a*, 45*a*, 55*a* undermost electrically insulating layer (lower insulating cover layer)
15*b*, 25*b*, 35*b*, 45*b*, 55*b* uppermost electrically insulating layer (upper insulating cover layer, surface course)
16*a* button portion (depression member)
16*d* engaging portion (depression member)
17 chassis
18 LED (Light Emitting Element)
19 heat generating part (electronic part which generates heat)
24*e*, 25*e*, 34*e*, 44*e* opening inner edge (the inner edge of an opening portion)
51*c* ground pattern (electrically conductive portion)

BEST MODE FOR CARRYING OUT INVENTION

The present invention will now be described in detail in accordance with a preferred embodiment shown in the accompanying drawings.

First Embodiment

FIGS. 1-6 show a first embodiment of the electronic apparatus according to the present invention.

Figure 3:
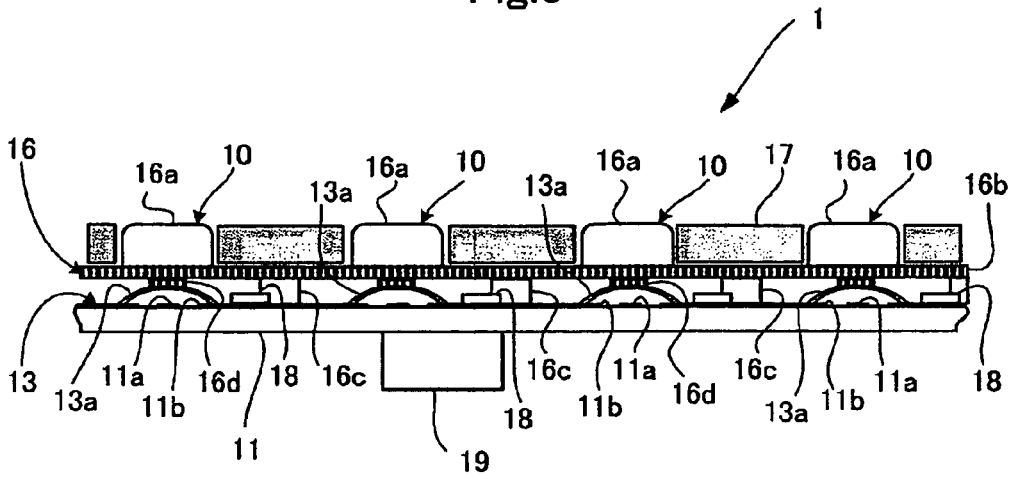
FIG. 3 is a side sectional view of the main part of the electronic apparatus showing a plurality of push button switches.
Figure 15:
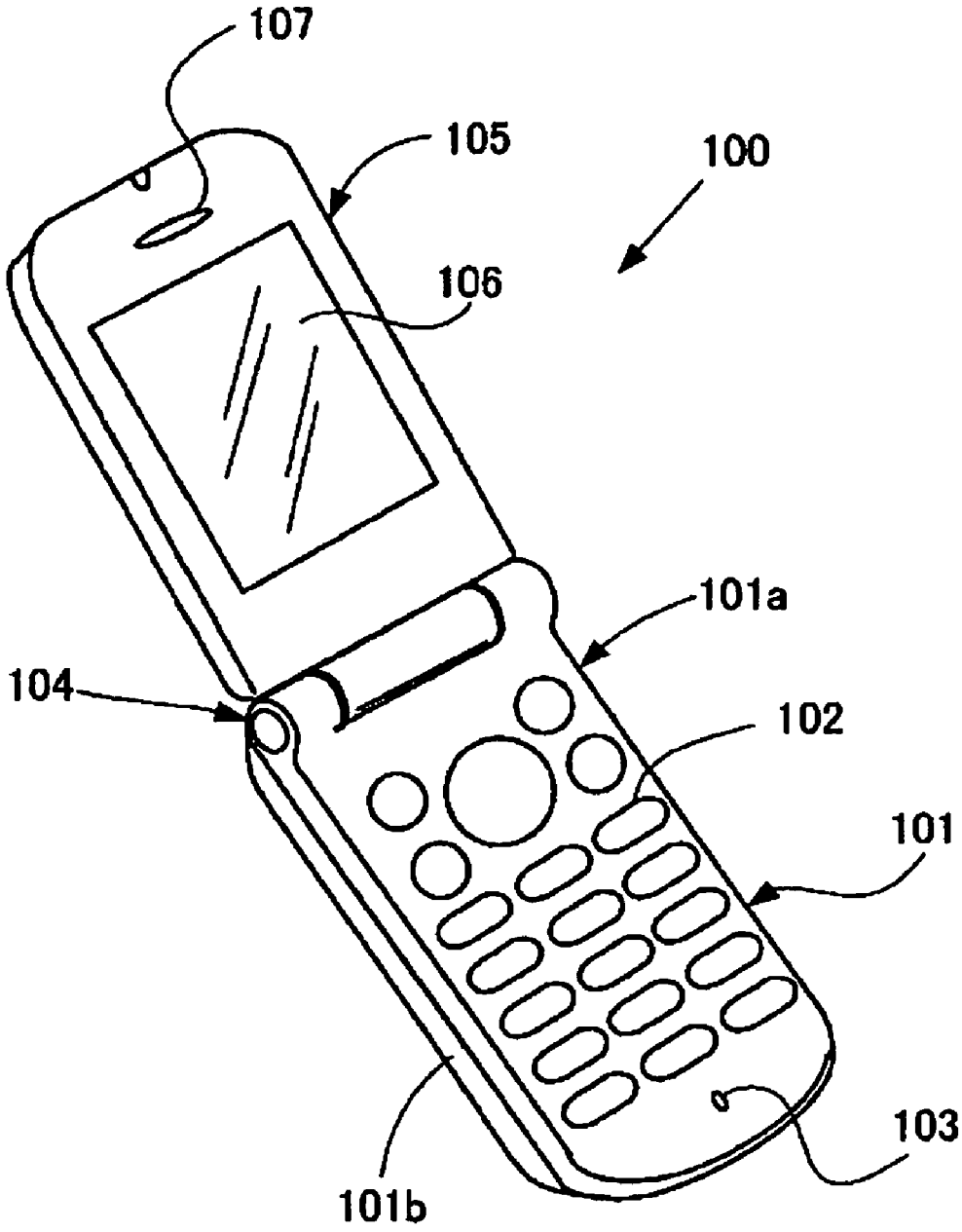
FIG. 15 is an external perspective view of a conventional mobile phone.
Figure 16:
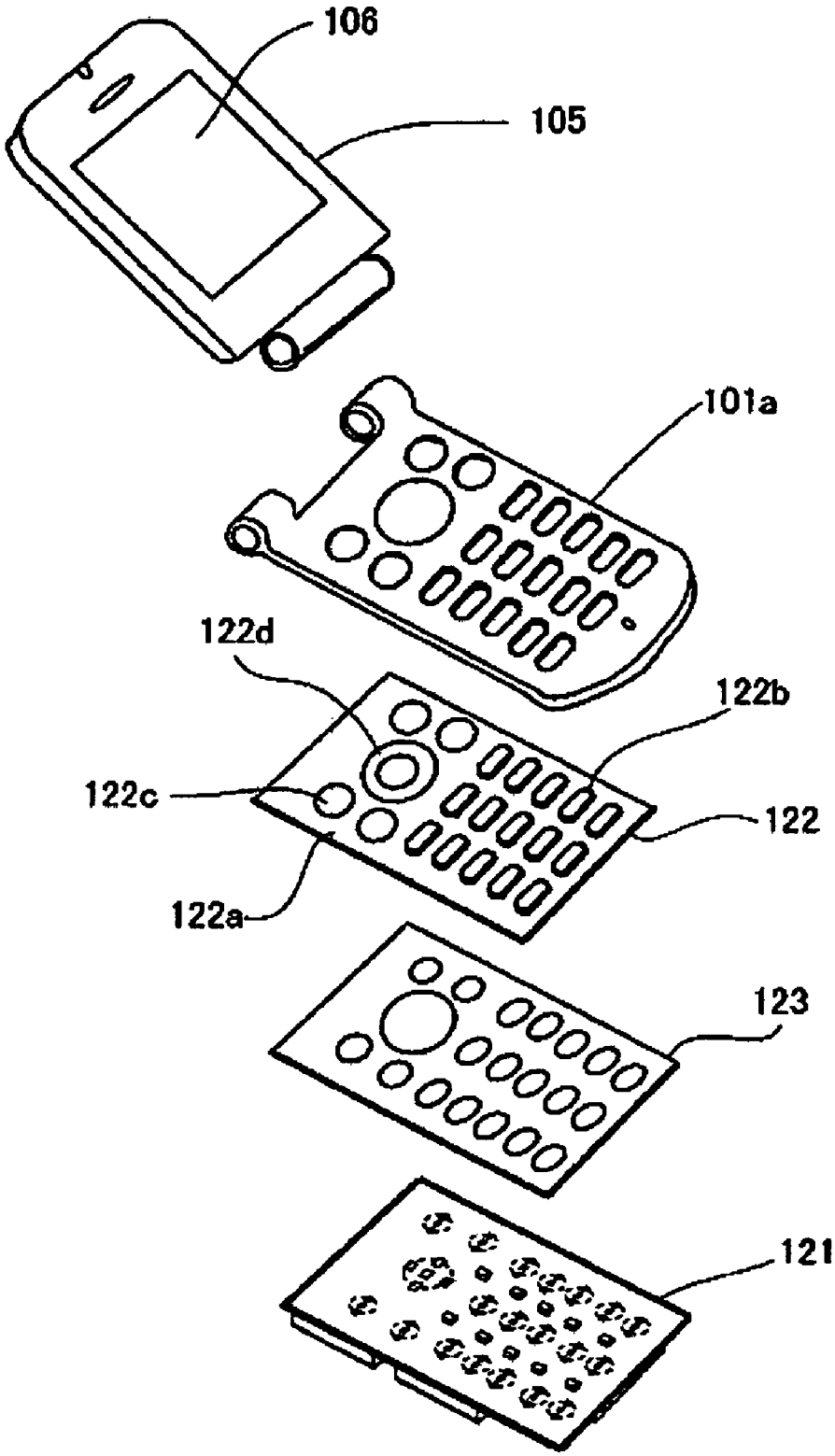
FIG. 16 is an exploded perspective view of the main part of the conventional mobile phone.
Figure 17:
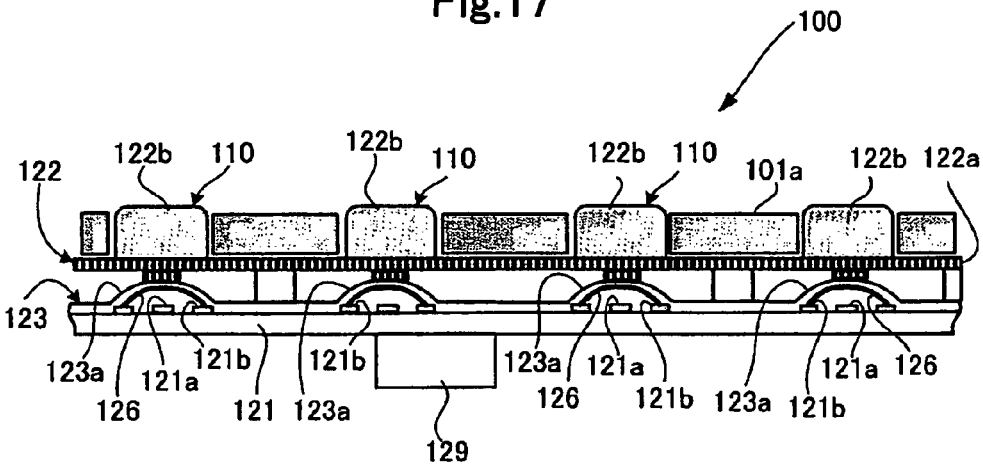
FIG. 17 is a side sectional view showing a plurality of depression switches forming part of the main part of the conventional mobile phone.

The present embodiment is exemplified in a preferred electronic apparatus 1, as comprising a compact and thin type chassis 17 and a plurality of push button switches 10 each provided in the chassis 17 as shown in FIG. 3. The electronic apparatus 1 in appearance has an exterior the same as or similar to that of the conventional mobile phone shown in FIG. 15. The electronic apparatus 1 may be any one of other compact and thin portable/mobile electronic apparatuses such as for example a PDA (Personal Digital Assistant).

Figure 1:
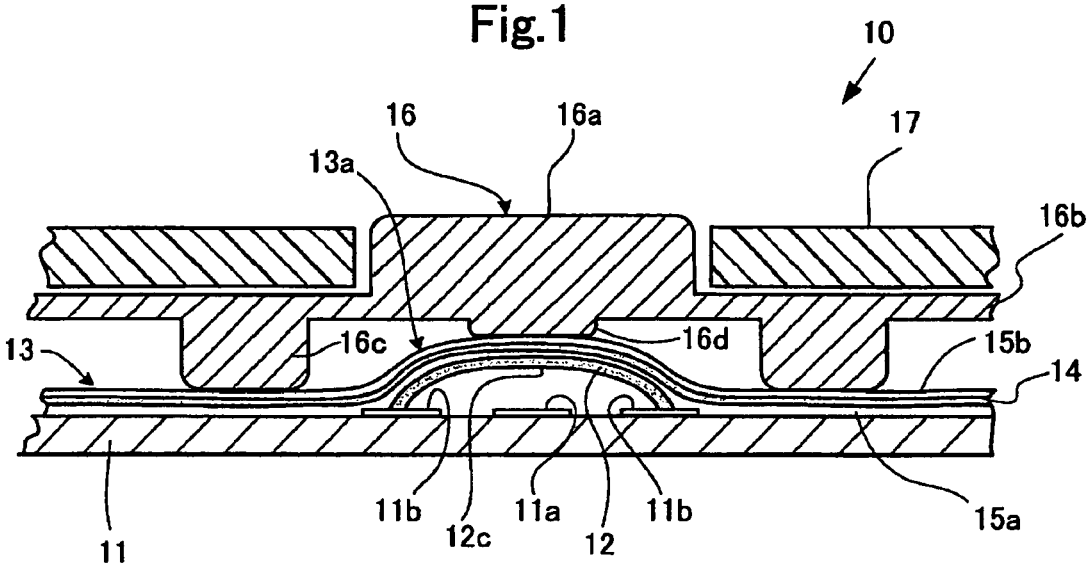
FIG. 1 is a side sectional view of a first embodiment of the push button switch of the electronic apparatus according to the present invention.

As shown in FIG. 1, each of the push button switches 10 according to the present embodiment comprises, on a printed circuit substrate 11, a first contacting part 11*a* and a second contacting part 11*b* operable to be brought into electrical conduction with the first contact 11*a*, and a flexible electrically insulating sheet 13 (i.e., an electrically insulating layer) covering the upper side surface of the printed circuit substrate 11. The electrically insulating sheet 13 has a click portion 13*a* in which the first contacting part 11*a* and the second contacting part 11*b* are so disposed as to be brought into and out of electrical conduction therebetween in response to depression of the click portion 13*a* of the electrically insulating sheet 13. The click portion 13*a* is shaped into a projection portion having an approximately arcuate section and projecting from the flat sheet portion of the electrically insulating sheet 13 by a predetermined projection height toward the operational surface side of the electronic apparatus 1. The click portion 13*a* also has its approximately circular peripheral portion raised from the surface of the printed circuit substrate 11. Incidentally, the click portion 13*a* may not be projected or convexed on condition that the click portion 13*a* is out of operation (out of switch depression force). In other words, the click portion 13*a* may be flattened to be vertically in coincidence with the flat sheet portion of the electrically insulating sheet 13 under the state that the click portion 13*a* is out of operation (out of switch depression force). The flat click portion 13*a* may be depressed by the switch depression force to form a spherical concave portion so as to displace a movable contact provided on one side close to the printed circuit substrate 11 (i.e., inside of the click portion) toward the stationary contact, and resiliently return to its initial position with the click portion 13*a* when the switch depression force is released from the click portion 13*a*. The resilient return force of the click portion may be produced only by the electrically insulating sheet 13 or mainly produced by a conductive member forming the contact or other electrically conductive members engageable with the first and second contacting parts. The click portion of the electrically insulating sheet is therefore required only to be flexible to the degree sufficient to produce an elastic deformation and move the movable contact in response to the switch depression force. The peripheral portion of the click portion may be arbitrarily shaped in response to the shape of a depression member through which the switch depression force is transferred.

As shown in FIG. 3, the printed circuit substrate 11 and the push button switches 10 are housed in the chassis 17. In the chassis 17 of the electronic apparatus 1 is further provided a key sheet 16. This key sheet 16 is constituted by a plurality of button portions 16*a* each operative to depress the corresponding click portion 13*a* of the electrically insulating sheet 13 and a flexible viscoelastic, e.g., rubber elastic sheet 16*b* on which the button portions 16*a* are mounted. The rubber elastic sheet 16*b* is provided and integrally formed on its underside with a plurality of support projection portions 16*c* and a plurality of engaging portions 16*d* (i.e., depression member) each engageable to the click portion 13*a* of the electrically insulating sheet 13.

Concretely, as shown in FIG. 1, the second contacting parts 11*b* on the printed circuit substrate 11 are separated from each other or collectively formed into an annular shape to have the first contact part 11*a* put therebetween or therein in the direction along the surface of the printed circuit substrate 11 (right and left sides in FIG. 1; hereinafter referred to as "surface direction"). These first and second contacting parts 11*a* and 11*b* are each electrically connected to an electronic control circuit, not shown in the drawing, provided on one side or/and the other side of the printed circuit substrate 11.

Figure 2A:
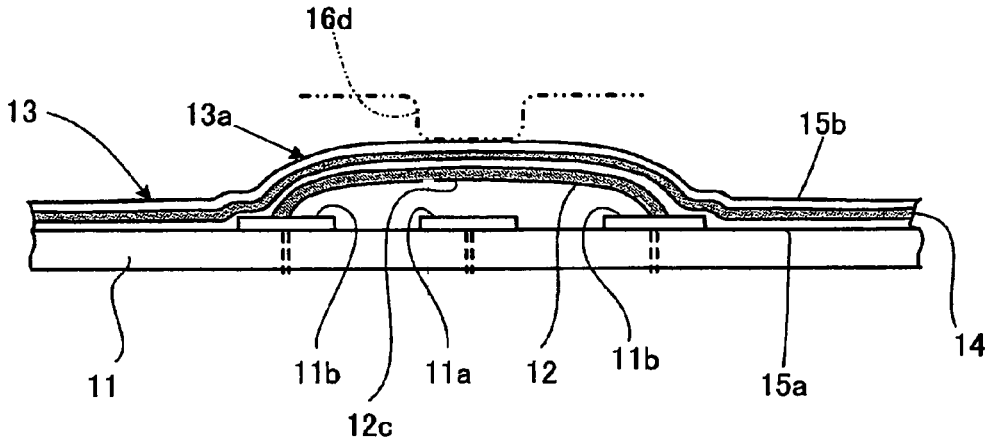
FIG. 2 are enlarged side sectional views in combination showing the main part of the push button switch shown in FIG. 1, and include FIG. 2(*a*) showing a click portion forming part of the main part and FIG. 2(*b*) showing a periphery of an electrically insulating layer forming part of the main part.
Figure 2B:
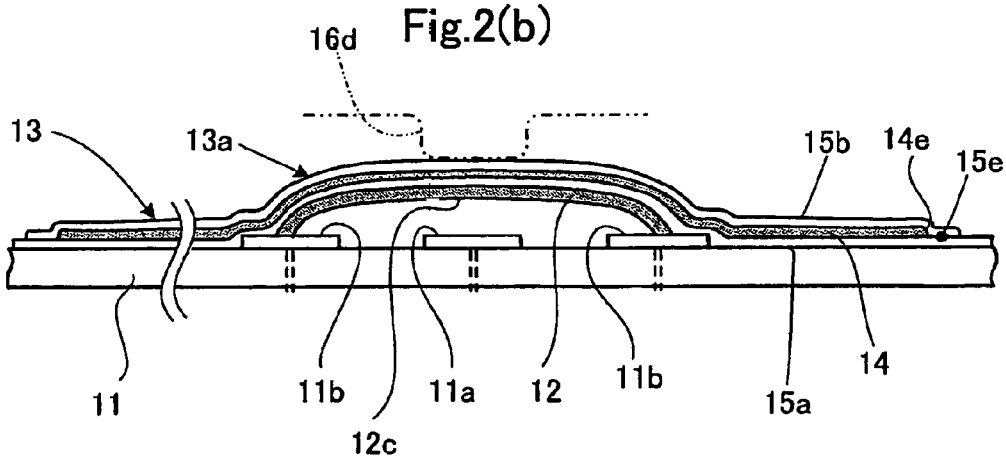
Figure 4:
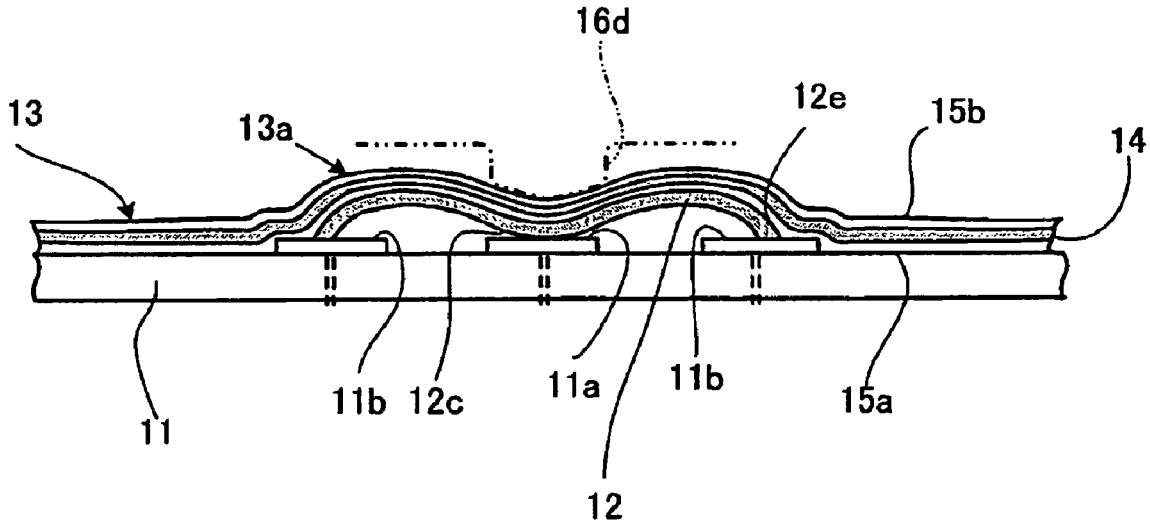
FIG. 4 is an enlarged side sectional view of the main part of the push button switch corresponding to FIG. 2 and showing the depressed click portion of the push button switch.

Further, the second contacting parts 11*b* positioned on both sides of the first contact 11*a* in FIG. 1 are held in contact with a third contacting part 12 exemplified by an electrically conductive diaphragm made of metal (e.g., an electrically conductive dished metal plate spring having an approximately arcuate section). The third contacting part 12 is securely retained on the inside surface of the click portion 13*a* of the electrically insulating sheet 13. The third contacting part 12 has a center portion 12*c* designed to function as a movable contact through which the first contact 11*a* and the second contact 11*b* can be brought into electrical conduction with each other when the third contacting part 12 is depressed by the switch depression force (i.e., the operational force for switching the push button switch) from one of the button portions 16*a* of the key sheet 16 through the corresponding click portion 13*a* of the electrically insulating sheet 13 and the center portion 12*c* is displaced to be close to the first contact 11*a* as shown in FIG. 4. When the switch depression force from one of the button portions 16*a* of the key sheet 16 is released, the center portion 12*c* of the third contacting part 12 is brought out of contact and electrical conduction with the first contact 11*a* and resiliently returns to a predetermined position, i.e., a home position distant from the first contact 11*a* as shown in FIG. 1 and FIG. 2(*a*).

In the meantime, the electrically insulating sheet 13 includes a heat conducting layer 14 extending along the printed circuit substrate 11, an undermost insulating layer 15*a* (i.e., a lower insulating cover layer) positioned on the lower side of the heat conducting layer 14 with the printed circuit substrate 11, and an uppermost insulating layer 15*b* (i.e., an upper insulating cover layer) positioned on the upper side of the heat conducting layer 14 against the printed circuit substrate 11. Here, the heat conducting layer 14 has a thermal conductivity higher than that of each of the printed circuit substrate 11 and the insulating layers 15*a*, 15*b* of the electrically insulating sheet 13, and is constituted by a graphite sheet or a highly heat-conductive metal sheet. The undermost insulating layer 15*a* is composed of an electrically insulating resin material layer, e.g., a PET (polyethylene terephthalate) sheet and an adhesive or insulating adhesive layer not shown in the drawings. Similarly, the undermost insulating layer 15*b* is composed of an electrically insulating resin material layer, e.g., a PET (polyethylene terephthalate) sheet.

The undermost insulating layer 15*a* of the electrically insulating sheet 13 forms an insulating retainer layer securely retaining the third contacting part 12 and securely adhered onto the printed circuit substrate 11, while, on the other hand, the uppermost insulating layer 15*b* forms an insulating cover layer securely adhered onto the heat conducting layer 14 so as to cover and protect the heat conducting layer 14. As shown in FIG. 2(*b*), the heat conducting layer 14 is extended over a certain operational area within which at least one click portion 13*a* or all of the click portions 13*a* are disposed. The insulating layers 15*a*, 15*b* are tacked to each other or united by adhesion or the like to form a tacked portion 15*e*, and cover and surround not only the lower and upper side surfaces of the heat conducting layer 14 but also the contour, i.e., the peripheral surface region 14*e* of the heat conducting layer 14. Parenthetically, the peripheral edge portion of the electrically insulating sheet 13 is preferably covered and electrically insulated, but can be cut off to expose the peripheral surface region 14*e* of the heat conducting layer 14. One of the insulating layers 15*a*, 15*b* forming the insulating cover layer, e.g., the insulating layer 15*b* is larger in area than the heat conducting layer 14 and sufficient in area to cover the heat conducting layer 14. However, one of the insulating layers 15*a*, 15*b*, e.g., the insulating layer 15*b* may be the same in area as the other of the insulating layers 15*a*, 15*b*, e.g., the insulating layer 15*a* extending over the whole area of the electrically insulating sheet 13, or smaller in area than the insulating layer 15*a*.

As aforementioned, according to the present embodiment, the heat conducting layer 14 is provided between the insulating layer 15*a*, i.e., the insulating retainer layer retaining the third contacting part 12 and securely adhered to the printed circuit substrate 11 and the insulating layer 15*b*, i.e., the insulating cover layer covering the heat conducting layer 14. And, the heat conducting layer 14 is on one side of the insulating layer 15*a*, i.e., the insulating retainer layer against the printed circuit substrate 11. The insulating layer 15*a*, the heat conducting layer 14 and the insulating layer 15*b* are laminated and securely integrally adhered to one another so as to collectively constitute the electrically insulating sheet 13, the undermost layer portion of which is securely mounted on the printed circuit substrate 11 by adhesion or the like.

In the click portion 13*a* of the electrically insulating sheet 13, the third contacting part 12 is positioned and retained by the click portion 13*a* to be above or on the first and second contacting parts 11*a*, 11*b* with the lower edge portion of the third contacting part 12 being held in contact with the second contact 11*b* on each side of the first contact 11*a*.

The key sheet 16 is also disposed on one side of the electrically insulating sheet 13 against the printed circuit substrate 11. The plurality of button portions 16*a* of the key sheet 16, i.e., the key tops are exposed to the outside of the chassis 17 through the corresponding opening portions 17*a* of the chassis 17, while each of the engaging portions 16*d* on the lower side surface of the key sheet 16 is held in contact with the corresponding one of the click portions 13*a* of the electrically insulating sheet 13 at the position just below the corresponding one of the button portions 16*a*.

As shown in FIG. 3, on the upper side of the printed circuit substrate 11, i.e., on the same side as the key sheet 16 are mounted a plurality of light emitting elements such as for example a plurality of LEDs (Light Emitting Diodes) 18, while on the lower side of the printed circuit substrate 11 are mounted a heat generating part 19 such as a power amplifier or the like and many other electronic parts not shown in the drawing.

Hereinafter, the operation of the present embodiment is described.

When any one of the button portions 16*a* of the key sheet 16 is depressed, the corresponding one of the engaging portions 16*d* just below the depressed button portion 16*a* downwardly moves one of the click portions 13*a* of the electrically insulating sheet 13 so as to depress the third contacting part 12 retained by the click portion 13*a*. At this time, the depressed third contacting part 12 is brought into deformation enough to bring the center portion 12*c* of the third contacting part 12 into contact with the first contact 11*a* as shown in FIG. 4 until the first contact 11*a* and the second contact 11*b* are electrically connected with each other through the third contacting part 12. This leads to that the switching state of the push button switch 10 is changed from one to another/the other. For example, the switching state is changed from the open and disconnected state to the closed and connected state at this time. In this case, the push button switch 10 is normal-open type, but can be changed to a normal close type.

On the other hand, when the switch depression force exerted on one of the button portions 16*a* of the key sheet 16 is released, and the corresponding one of the engaging portion 16*d* just below the depressed button portion 16*a* is upwardly moved by one of the click portion 13*a* of the electrically insulating sheet 13 as the click portion 13*a* of the electrically insulating sheet 13 and the third contacting part 12 return to their respective initial states and home positions. At this moment, the third contacting part 12 brings its center portion 12*c* out of contact with the first contact 11*a* as shown in FIG. 2 and resiliently returns into the initial state to have an initial curvature and arcuate section until the first contact 11*a* and the second contact 11*b* are electrically disconnected from each other. This results in that the switching state of the push button switch 10 is changed back to one from another/the other. For example, the switching state is changed at this time to the open and disconnected state from the closed and connected state.

In the meantime, when the electronic apparatus 1 is operated, the heat generating part 19 such as the power amplifier or the like on the printed circuit substrate 11 tends to generate heat by which the chassis 17 and the parts in the chassis 17 are raised in temperature around the heat generating part 19.

Under these conditions, the heat generated from the parts on the printed circuit substrate 11 is effectively transmitted in the surface direction (i.e., extending direction) of the heat conducting layer 14 through the heat conducting layer 14. Because of the existence of the heat conducting layer 14, the heat is diffused effectively in the surface direction of the printed circuit substrate 11, and the printed circuit substrate 11 including a large number of electronic parts is efficiently heat soaked. In addition, the heat generated from the heat generating part 19 is broadly diffused in the surface direction of the printed circuit substrate 11 by the reason that the heat conducting layer 14 extends along the printed circuit substrate 11 to be close to the printed circuit substrate 11. This makes it possible to increase efficiency of heat radiation from the heat generating part 19 and other surrounding parts. Consequently, it is possible to assuredly prevent the heat generating part 19 and other surrounding parts in the electronic apparatus 1 from being highly raised in temperature to the degree that the user feels partly uncomfortable in surface temperature of the chassis 17.

It is also possible to produce the electrically insulating sheet 13 to have superiorly heat conductivity in spite of the sufficient insulating ability because of the fact that the heat conducting layer 14 is interposed between the upper and lower insulating cover layers, i.e., the insulating retainer layer 15*a* on the printed circuit substrate 11 and the insulating cover layer 15*b* for covering the heat conducting layer 14. Efficiency of diffusing the heat generated from the heat generating part 19 and the like in the chassis 17 can therefore be improved. In the case that the heat conducting layer 14 is composed of a graphite sheet, thermal conductivity in the surface direction of the graphite sheet is not less than 700 W/(m·k). The thermal conductivity is high sufficient to increase efficiency of heat radiation from the heat generating parts of the electronic apparatus 1.

In the case that the heat conducting layer 14 is made of a graphite sheet, the graphite sheet can be thinned down to 100 micrometer thick or less. This enables to remarkably reduce the thickness of the electrically insulating sheet 13 and the thickness of the electronic apparatus 1. In addition, the thinned click portion 13*a* of the electrically insulating sheet 13 makes it possible to improve the click feeling during the switch depression operation by the main reason that the third contacting part 12 having elasticity and an arcuate section is adhered on the inside of the click portion 13*a*. It is therefore possible to produce a durable and tactile push button switch 10 superiorly improved in operational feeling (such as the click feeling).

According to the present embodiment, the electrically insulating sheet 13 includes the uppermost insulating layer 15*b* positioned on one side of the heat conducting layer 14 against the printed circuit substrate 11, and the undermost insulating layer 15*a* positioned on the other side of the heat conducting layer 14 with the printed circuit substrate 11. And, the undermost insulating layer 15*a* and the uppermost insulating layer 15*b* are tacked to each other or united so as to cover and surround the peripheral surface region 14*e* of the heat conducting layer 14. It is therefore possible to produce the highly heat-conductive electrically insulating sheet 13 having the heat conducting layer 14 inserted between the insulating layers 15*a*, 15*b*.

Additionally, it is possible to automatically dispose the heat conducting layer 14 to be close to the printed circuit substrate 11 only by mounting the electrically insulating sheet 13 on the printed circuit substrate 11, since the electrically insulating sheet 13 is constituted by the insulating layers 15*a*, 15*b* each extending along the printed circuit substrate 11 and the heat conducting layer 14 securely adhered to at least one of the insulating layers 15*a*, 15*b*. The number of assembly processes of the present embodiment can therefore be reduced.

Further, in the case that the button portions 16*a* of the key sheet 16 are illuminated by light emitted from the LEDs 18 mounted on the printed circuit substrate 11 and that at least one layer 15*b* of the insulating layers 15*a*, 15*b* of the electrically insulating sheet 13 has in whole or in part (e.g., in surface course) a white or glossy portion, the light emitted from the LEDs 18 can be guided is optically guided by the white or glossy portion of the electrically insulating sheet 13 so as to sufficiently illuminate the button portions 16*a* of the key sheet 16 with uniform intensity and color of the illumination.

Figure 5A:
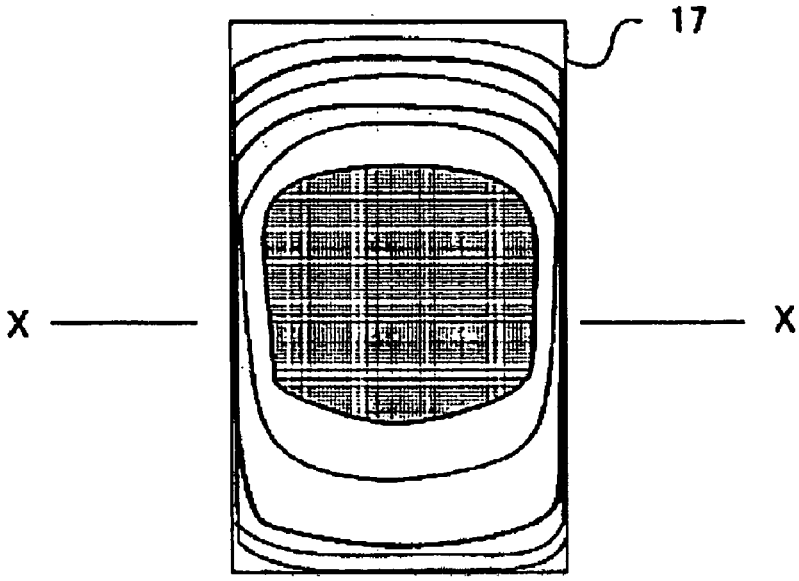
FIG. 5 are explanatory views in combination showing distribution of surface temperature of the electronic apparatus according to the first embodiment of the present invention, and include FIG. 5(*a*) showing the distribution of the surface temperature of the whole operational zone of the device and FIG. 5(*b*) showing the sectioned distribution profile of the surface temperature taken along a section line X-X in FIG. 5(*a*)
Figure 5B:
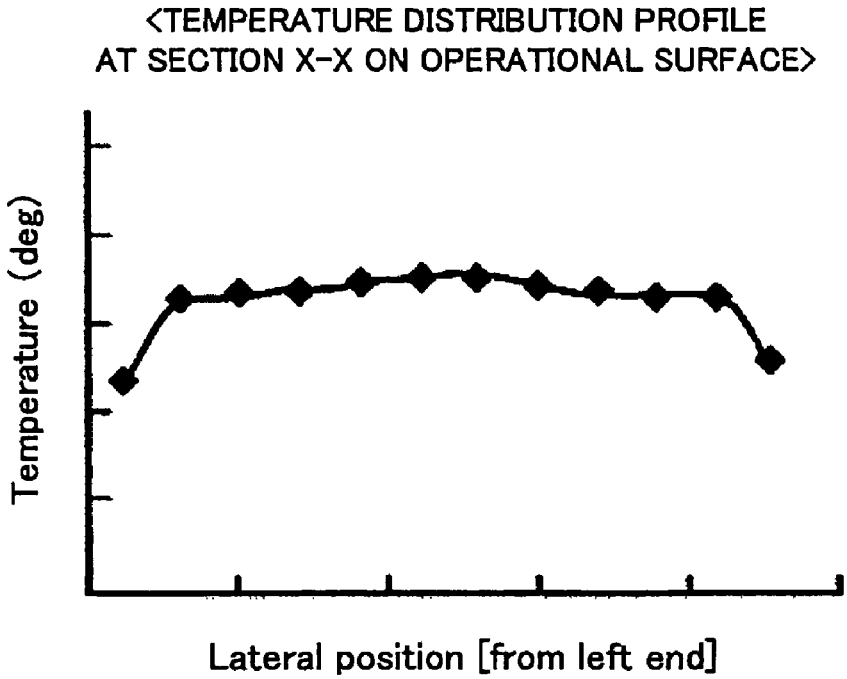

FIG. 5 in combination show a simulation result representative of the temperature distribution on the operational surface of the chassis 17 and calculated based on the positions of the heat generating part 19 and amount of heat generated from each of the heat generating part 19 and the like in the electronic apparatus 1 according to the present embodiment. Particularly, FIG. 5(*a*) is explanatory view showing a temperature distribution image on the whole operational surface with a plurality of isothermal lines, and FIG. 5(*b*) is a graph showing a sectioned distribution profile of the surface temperature taken along a section line X-X in FIG. 5(*a*).

In this simulation, the chassis 17 has a thickness of 0.9 mm and a thermal conductivity of 0.3 W/(m·k), the printed circuit substrate 11 has a thickness of 0.5 mm and a thermal conductivity of 35 W/(m·k), the key sheet 16 has a thickness of 0.5 mm (corresponding to a height of 1 mm from the lower end of the support projection portion 16*c*) and a thermal conductivity of 0.2 W/(m·k), and the heat generating part 19 has a thickness of 1.0 mm and a thermal conductivity of 1 W/(m·k), while, on the other hand, the electrically insulating sheet 13 including the graphite heat conducting layer 14 has a thickness of 0.1 mm and a thermal conductivity (in the surface direction) of 700 W/(m·k). Here, the electrically insulating sheet 13 covers the area within which the plurality of button portions 16*a* are arranged, but does not exceed over the whole area of the printed circuit substrate 11.

In this electronic apparatus 1 according to the present embodiment, the chassis 17 is efficiently heat soaked in the coverage of the electrically insulating sheet 13 using the graphite sheet, and the temperature of the operational surface of the chassis 17 lies within an approximately constant temperature range in the area where the button portions 16*a* are arranged. The graph in FIG. 5(*b*) indicates a tolerable temperature rise on the operational surface within the range of several degrees in comparison with the temperature on the periphery (i.e., both side ends of the graphed line in this figure) of the chassis 17 difficult to be affected by the heat generated in the chassis.

Figure 6A:
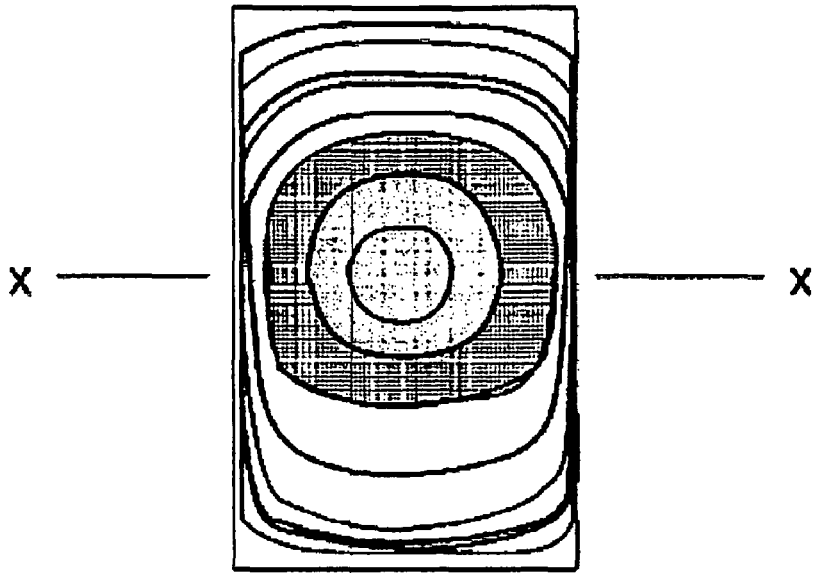
FIG. 6 are explanatory views in combination showing distribution of surface temperature of the comparative electronic apparatus, and include FIG. 6(*a*) showing the distribution of the surface temperature of the whole operational zone of the device and FIG. 6(*b*) showing the distribution of the surface temperature taken along section X-X in FIG. 6(*a*)
Figure 6B:
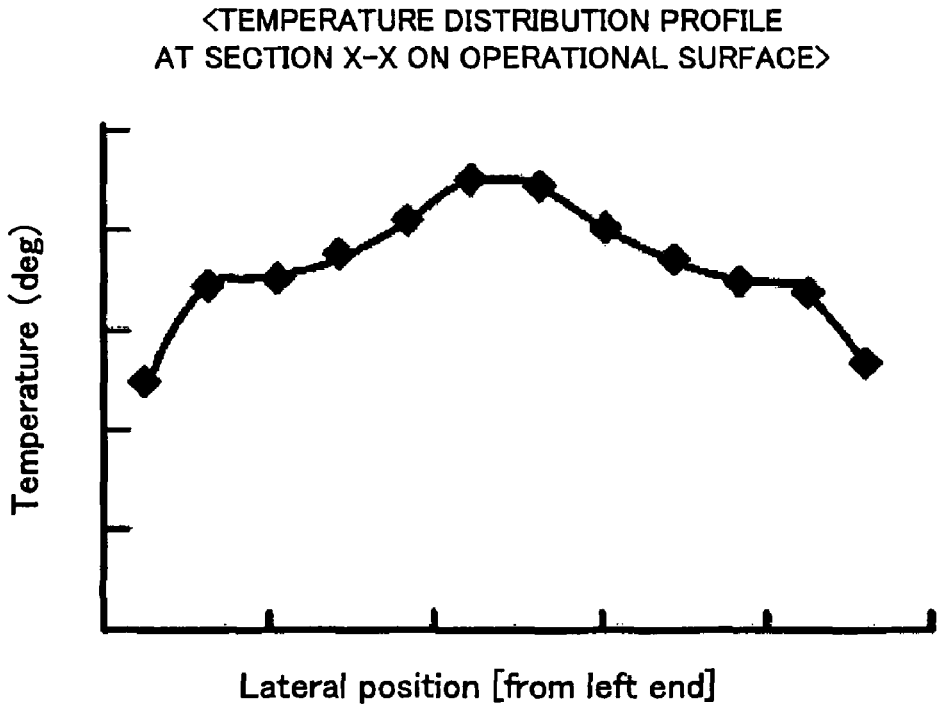

On the other hand, FIG. 6 in combination show another simulation result representing for comparison purpose the temperature distribution on the operational surface of the chassis of the electronic apparatus in which the heat conducting layer 14 is removed from the construction of the aforementioned embodiment. Particularly, FIG. 6(*a*) is an explanatory view showing a temperature distribution image on the whole operational surface with a plurality of isothermal lines, and FIG. 6(*b*) is a graph showing a sectioned distribution profile of the surface temperature taken along a section line X-X in FIG. 6(*a*).

In this electronic apparatus for comparison purpose, the surface temperature of the chassis becomes higher as the surface position nears the heat generating part 19 as shown in FIG. 6(*a*). It is therefore apparent that the chassis is not efficiently heat soaked in the coverage of the electrically insulating sheet. The graph of FIG. 6(*b*) indicates an intolerable surface temperature rise at the position close to the heat generating part 19, and the temperature rise is approximately twice as large as the tolerable temperature rise of the aforementioned embodiment. It is apparent that the surface temperature of the chassis is partly remarkably raised in comparison with the temperature on the periphery (i.e., both side ends of the graphed line in this figure) of the chassis difficult to be affected by the heat generated in the chassis.

It is accordingly apparent from the simulation result shown in FIG. 5 and the comparative simulation result shown in FIG. 6 that the electronic apparatus 1 according to the present embodiment can be efficiently heat soaked on the printed circuit substrate 11 to prevent the chassis 17 from being heated partially to high temperature in the vicinity of the heat generating part 19.

Second Embodiment

Figure 7:
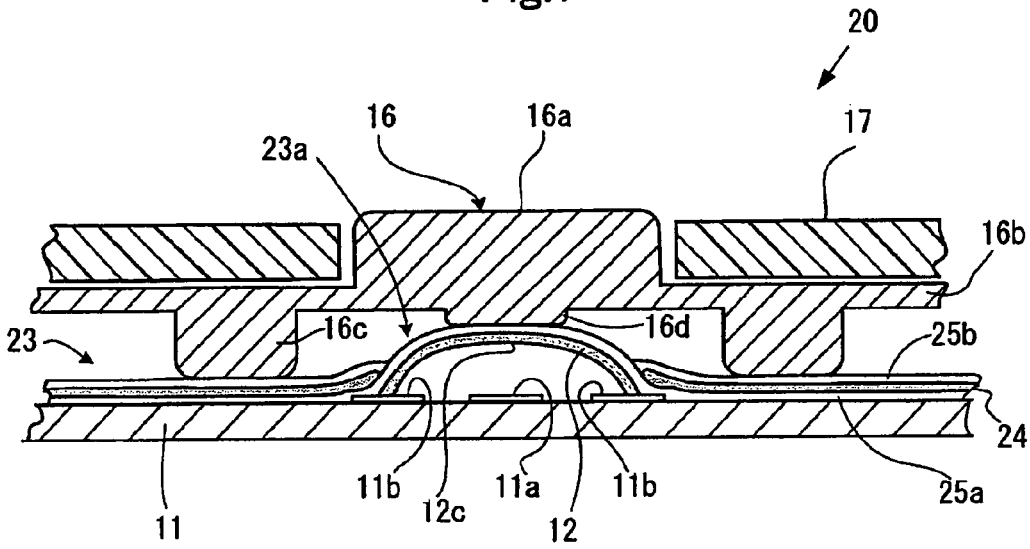
FIG. 7 is a side sectional view showing the main part of a second embodiment of the push button switch of the electronic apparatus according to the present invention.
Figure 8A:
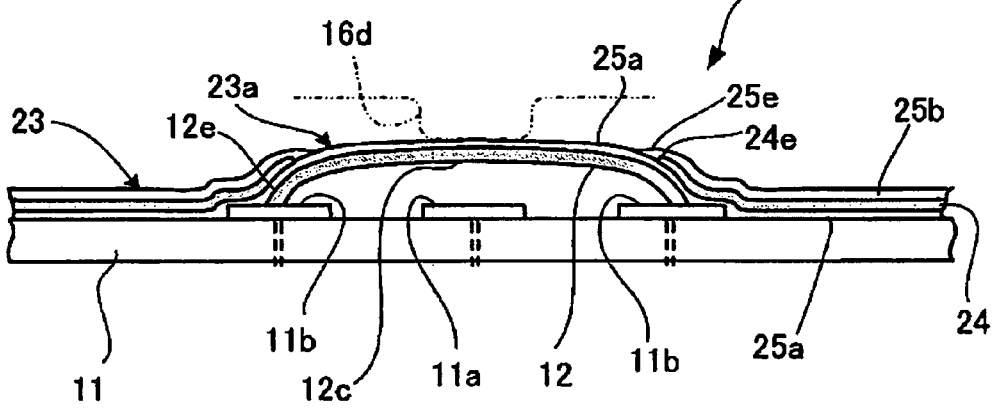
FIG. 8 are side sectional views each showing of the main part of the push button switch shown in FIG. 7, and include FIG. 8(*a*) showing an exemplified undermost electrically insulating retainer layer retaining the flexible second contact, and a heat conducting layer and an electrically insulating cover layer both laid on the undermost layer and having their respective opening portions each corresponding to the click portion, and FIG. 8(*b*) showing an exemplified uppermost electrically insulating layer retaining the flexible second contact, and a heat conducting layer and an electrically insulating cover layer both laid under the uppermost layer and having their respective opening portions each corresponding to the click portion.
Figure 8B:
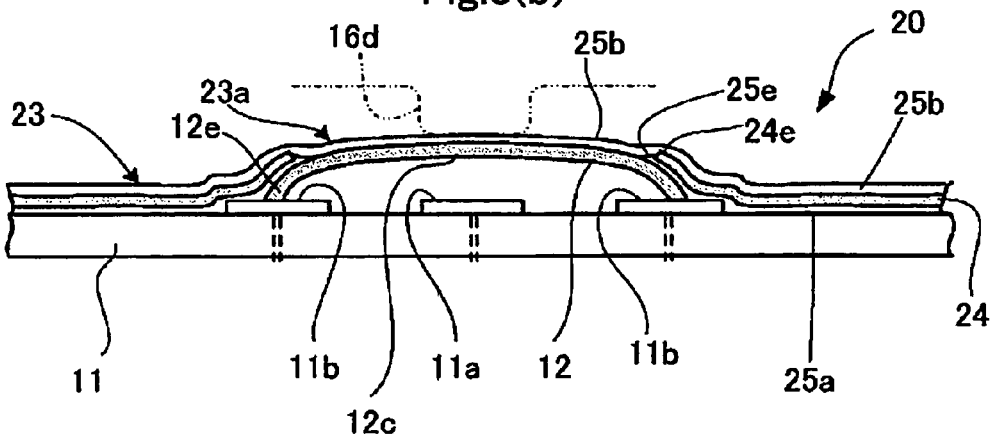
Figure 9A:
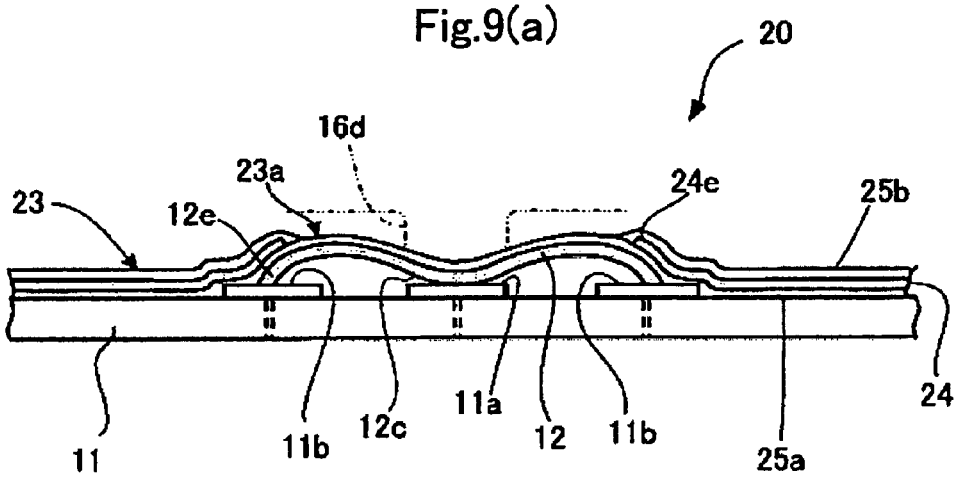
FIG. 9(*a*) and FIG. 9(*b*) are enlarged sectional views of the push button switch respectively corresponding to FIG. 8(*a*) and FIG. 8(*b*) and each showing the depressed click portion of the push button switch.
Figure 9B:
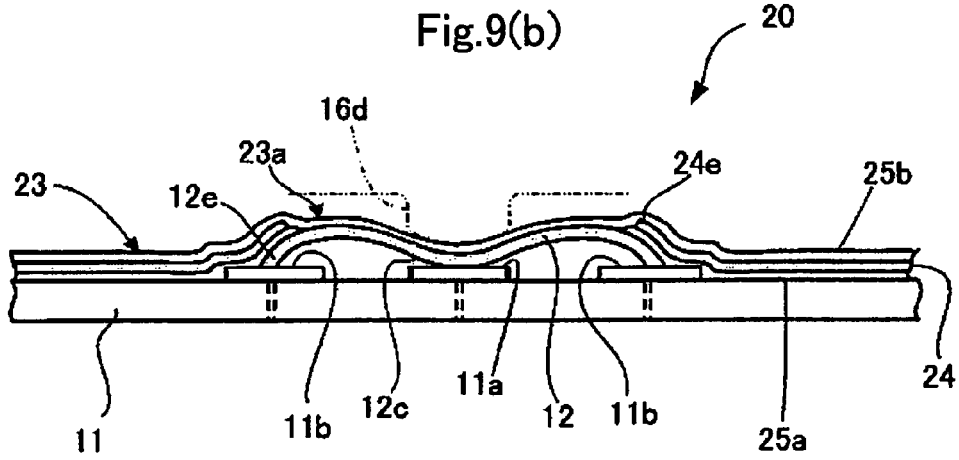

FIGS. 7-9 show a second embodiment of the electronic apparatus according to the present invention.

The electronic apparatus according to the present embodiment is a compact and thin portable electronic apparatus equipped with a plurality of push button switches 20 in the chassis in the same manner as in the aforementioned first embodiment. This electronic apparatus in appearance has an exterior the same as or similar to that of the conventional mobile phone shown in FIG. 15. Here, the constituent elements the same as those in the aforementioned first embodiment bear their respective reference numerals the same as those shown in FIGS. 1 to 4, and are omitted in detailed description thereof.

As shown in FIG. 7, each of the push button switches 20 according to the present embodiment comprises, on the printed circuit substrate 11, the first contacting part 11*a* and the second contacting part 11*b* operable to be brought into electrical conduction with the first contact 11*a*, and a flexible electrically insulating sheet 23 (i.e., an electrically insulating layer) covering the upper side surface of the printed circuit substrate 11. The insulating sheet 23 has a click portion 23*a* on the inside of which the first contacting part 11*a* and the second contacting part 11*b* are so disposed as to be brought into and out of electrical conduction therebetween in response to depression of the click portion 23*a* of the electrically insulating sheet 23. The printed circuit substrate 11 and the push button switches 20 are housed in the chassis 17 of the electronic apparatus 1. In the chassis 17 is additionally provided a key sheet 16.

Concretely, as shown in FIG. 7, the second contacting parts 11*b* on the printed circuit substrate 11 are separated from each other or collectively formed into an annular shape to have the first contact part 11*a* put therebetween or therein in the surface direction of the printed circuit substrate 11. The second contacting parts 11*b* positioned on both sides of the first contact 11*a* in FIG. 1 are held in contact with the third contacting part 12.

When the third contacting part 12 is depressed by the switch depression force from one of the button portions 16*a* of the key sheet 16 through the corresponding click portion 23*a* of the electrically conductive sheet 23, the center portion 12*c* is displaced to be close to the first contact 11*a* as shown in FIG. 9 so as to bring the first contact 11*a* and the second contact 11*b* into electrical connection with each other. When the switch depression force from one of the button portions 16*a* of the key sheet 16 is released, the center portion 12*c* of the third contacting part 12 is brought out of contact and electrical conduction with the first contact 11*a* and resiliently returns to the predetermined home position distant from the first contact 11*a* as shown in FIG. 7 and FIG. 8.

Meanwhile, the electrically insulating sheet 23 includes a heat conducting layer 24 and lower and upper insulating layers 25*a*, 25*b* (i.e., insulating cover layers) each extending along the printed circuit substrate 11. Here, the heat conducting layer 24 has a thermal conductivity higher than those of the printed circuit substrate 11 and the insulating layers 25*a*, 25*b* of the electrically insulating sheet 23, and is for example constituted by a graphite sheet or a highly heat-conductive metal sheet. Each of the insulating layers 25*a*, 25*b* is composed of an electrically insulating resin material layer, e.g., a PET sheet.

As shown in FIG. 8(*a*), the undermost insulating layer 25*a* (i.e., lower insulating cover layer) of the electrically insulating sheet 23 forms an insulating retainer layer retaining the third contacting part 12 and securely adhered onto the printed circuit substrate 11, while on the other hand the uppermost insulating layer 25*b* (i.e., upper insulating cover layer) of the electrically insulating sheet 23 forms an insulating cover layer securely adhered onto the heat conducting layer 24 so as to cover the heat conducting layer 24. The heat conducting layer 24 and the upper insulating layer 25*b* have their respective opening portions, e.g., the circular opening portions, corresponding to the click portion 23*a* of the electrically insulating sheet 23, and the inner edges of the opening portions each extend along the contour of the click portion 23*a*. As shown in FIG. 8(*a*), the circular peripheral edge portion 12*e* of the third contacting part 12 and the opening inner edges 24*e*, 25*e* are overlapped with one another. This means that the electrically insulating sheet 23 has a thin portion singly composed of the insulating layer 25*a* within the area where the electrically insulating sheet 23 and the center portion 12*c*, i.e., the movable contact are overlapped, and that the click portion 23*a* of the electrically insulating sheet 23 is sufficiently flexible.

As shown in FIG. 8(*b*), the electrically insulating sheet 23 may include an undermost insulating layer 25*a* formed with an opening corresponding to the click portion 23*a* in the same manner as the heat conducting layer 24. And, the opening inner edge 25*e* of the undermost insulating layer 25*a* may be overlapped with the opening inner edge 24*e* of the heat conducting layer 24. In this case, the uppermost insulating layer 25*b* of the electrically insulating sheet 23 forms an insulating retainer layer retaining the third contacting part 12 and fixedly connected to the printed circuit substrate 11 through the heat conducting layer 24 and the undermost insulating layer 25*a*. On the other hand, the undermost insulating layer 25*a* of the electrically insulating sheet 23 forms an insulating cover layer securely adhered onto the heat conducting layer 24 to cover and protect the heat conducting layer 24. In this modified form, the electrically insulating sheet 23 still has a thin portion singly composed of the insulating layer 25*b* within the area where the electrically insulating sheet 23 and the center portion 12*c*, i.e., the movable contact are overlapped, and that the click portion 23*a* of the electrically insulating sheet 23 is sufficiently flexible.

As shown in FIG. 8(*a*) or 8(*b*), the insulating layer 25*a*, the heat conducting layer 24 and the insulating layer 25*b* are laminated and securely integrally adhered to one another so as to collectively constitute the electrically insulating sheet 23, the undermost layer portion of which is securely mounted on the printed circuit substrate 11 by adhesion or the like. The undermost insulating layer 15*a* is composed of an electrically insulating resin material layer, e.g., a PET (polyethylene terephthalate) sheet and an adhesive or insulating adhesive layer not shown in the drawings. On the inside of the click portion 23*a* of the electrically insulating sheet 23, the third contacting part 12 is securely retained by the undermost insulating adhesive layer not shown in the drawings. And, the third contacting part 12 is positioned above or on the first and second contacting parts 11*a*, 11*b* of the printed circuit substrate 11 with the lower edge portion of the third contacting part 12 being held in contact with the second contact 11*b* on each side of the first contact 11*a*.

The rest of the constituent elements are the same as those in the aforementioned first embodiment.

According to the present embodiment, because of the existence of the heat conducting layer 24 extending along the printed circuit substrate 11, the heat generated from the parts on the printed circuit substrate 11 is effectively transmitted in the surface direction of the printed circuit substrate 11 to efficiently heat soak the printed circuit substrate 11 in spite of the fact that a number of electronic parts are mounted on the printed circuit substrate 11. The heat from the heat generating part 19 and the like on the printed circuit substrate 11 is broadly effectively diffused in the surface direction of the printed circuit substrate 11, and efficiently radiated and dissipated from the heat generating part 19 and the like. The push button switch according to the present embodiment therefore has the same effects as in the aforesaid first embodiment.

Further, according to the present embodiment, either one of the insulating layers 25*a*, 25*b* and the heat conducting layer 24 are formed with their respective openings corresponding to the click portion 23*a* of the electrically insulating sheet 23. And, the electrically insulating sheet 23 has a thin portion singly composed of the insulating layer 25*a* or 25*b* within the area where the click portion 23*a* of the electrically insulating sheet 23 is held in contact with the engaging portion 16*d* of the key sheet 16. This enables to reduce the height of the click portion 23*a* on the printed circuit substrate 11 to practically reduce the size and thickness of the electronic apparatus 1. This also improves the click feeling of the button portions 16*a* by means of the flexible third contract 12 having plate spring feature. Here, the click feeling means an operational feeling sensed by the user in the case that the reaction force from the button portion 16*a* is rapidly reduced when the stroke of the button portion 16*a* exceeds over a predetermined certain stroke to the degree that the user senses the stroke end of the button portion 16*a*.

According to the present embodiment, each of the first, second and third contacting parts 11*a*, 11*b* and 12 on the printed circuit substrate 11 can be prevented from being brought into electrical conduction with the heat conducting layer 24 in the case that the lower insulating layer 25*a* is exposed to the outside at the click portion 23*a* and the heat conducting layer 24 is electrically conductive. On the other hand, in the case that the upper insulating layer 25*b* is exposed to the outside at the click portion 23*a*, the electrically insulating layer 23 can be certainly prevented from being come off.

Third Embodiment

Figure 10A:
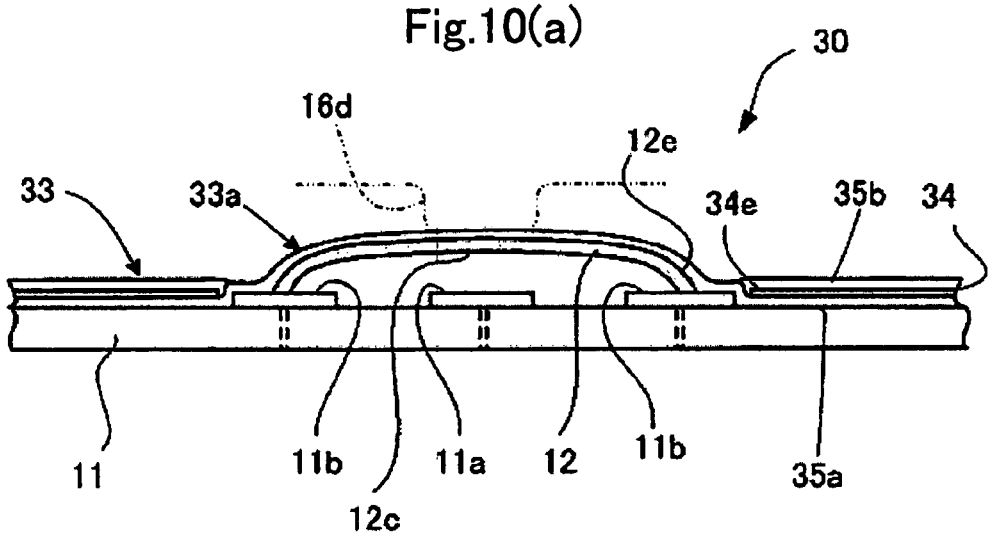
FIG. 10 are side sectional views each showing the main part of a third embodiment of the push button switch of the electronic apparatus according to the present invention, and include FIG. 10(*a*) showing an exemplified undermost electrically insulating retainer layer retaining the flexible second contact, and a heat conducting layer and an electrically insulating cover layer both laid on the undermost layer and having their respective opening portions each corresponding to the click portion, and FIG. 10(*b*) showing an exemplified uppermost electrically insulating layer retaining the flexible second contact, and a heat conducting layer and an electrically insulating cover layer both laid under the uppermost layer and having their respective opening portions each corresponding to the click portion.
Figure 10B:
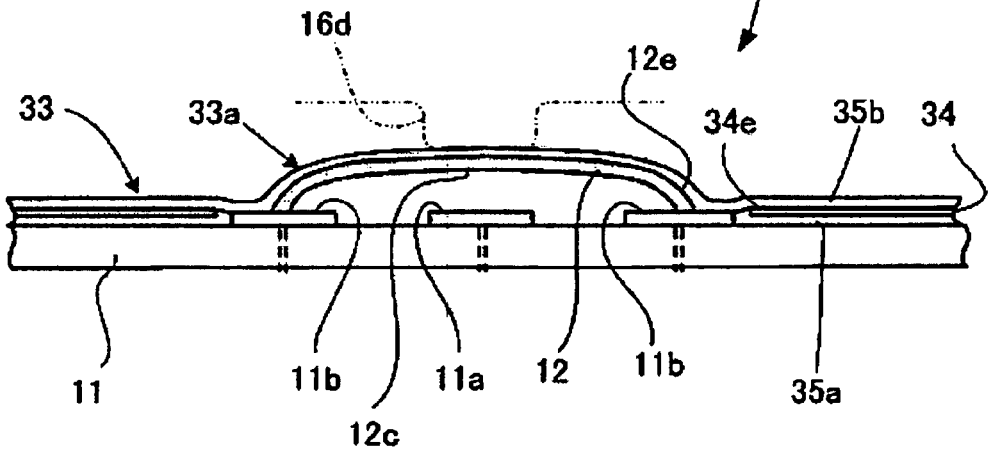
Figure 11A:
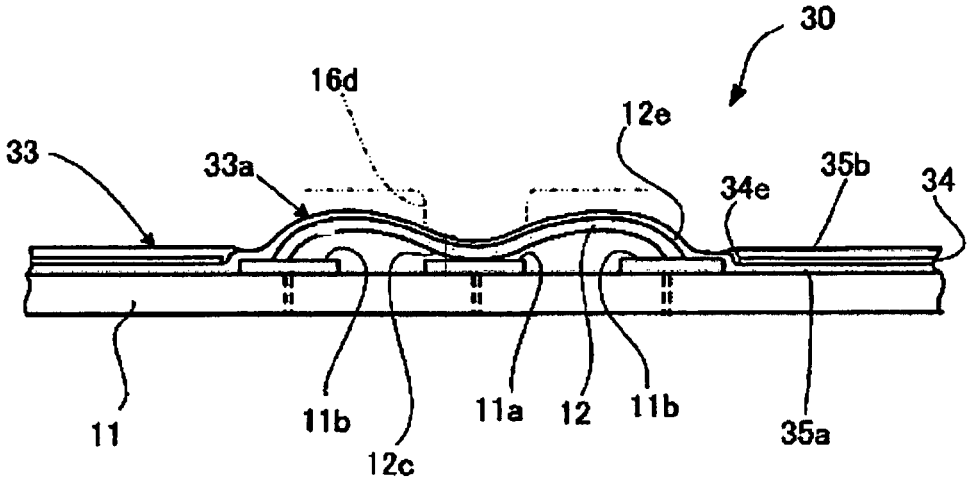
FIG. 11(*a*) and FIG. 11(*b*) are enlarged sectional views of the main parts of the push button switch respectively corresponding to FIG. 8(*a*) and FIG. 8(*b*) and each showing the depressed click portion of the push button switch.
Figure 11B:
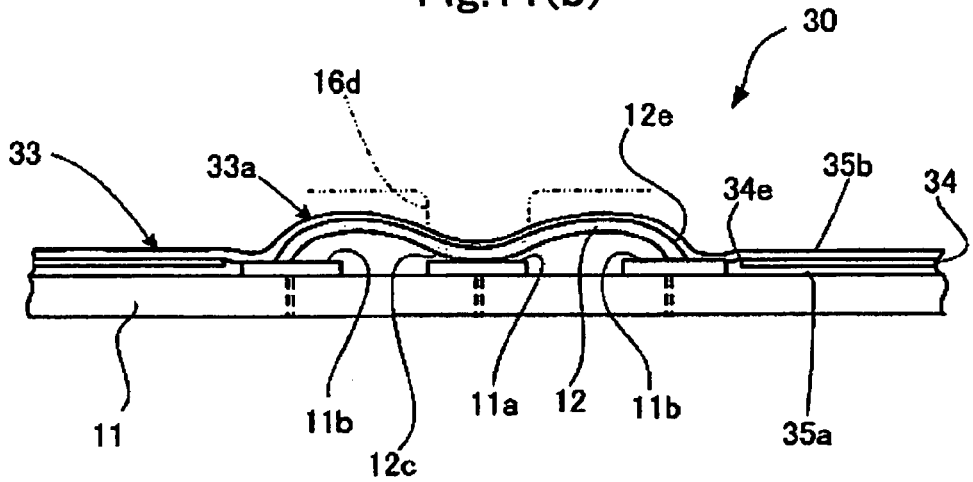

FIG. 10 and FIG. 11 in combination show a third embodiment of the electronic apparatus according to the present invention.

The electronic apparatus according to the present embodiment is a compact and thin portable electronic apparatus equipped with a plurality of push button switches 30 in the chassis in the same manner as in the aforementioned first embodiment. This electronic apparatus in appearance has an exterior the same as or similar to that of the conventional mobile phone shown in FIG. 15. The constituent elements the same as those in the aforementioned first embodiment bear their respective reference numerals the same as those shown in FIGS. 1 to 4, and are omitted in detailed description thereof.

As shown in FIGS. 10(*a*) and 10(*b*), each of the push button switches 30 according to the present embodiment comprises, on the printed circuit substrate 11, the first contacting part 11*a* and the second contacting part 11*b* operable to be brought into electrical conduction with the first contact 11*a*, and a flexible electrically insulating sheet 33 (i.e., an electrically insulating layer) covering the upper side surface of the printed circuit substrate 11. The electrically insulating sheet 33 has a click portion 33*a* on the inside of which the first contacting part 11*a* and the second contacting part 11*b* are so disposed as to be brought into and out of electrical conduction therebetween in response to depression of the click portion 33*a* of the electrically insulating sheet 33. The printed circuit substrate 11 and the push button switch 30 are housed in the chassis 17 of the electronic apparatus 1 with a key sheet 16 additionally provided in the chassis 17.

The third contacting part 12 has a center portion 12*c* operative to function as a movable contact through which the first contact 11*a* and the second contact 11*b* can be brought into electrical conduction with each other when the third contacting part 12 is depressed by the switch depression force from one of the button portions 16*a* of the key sheet 16 through the corresponding click portion 33*a* of the electrically insulating sheet 33 and the center portion 12*c* is displaced onto the first contact 11*a* as shown in FIG. 11(*a*) and 11(*b*). When the switch depression force is released from one of the button portions 16*a* of the key sheet 16, the center portion 12*c* of the third contacting part 12 is brought out of contact and electrical conduction with the first contact 11*a* and resiliently returns to a predetermined position, i.e., a home position distant from the first contact 11*a* as shown in FIGS. 10(*a*) and 10(*b*).

On the other hand, the electrically insulating sheet 33 includes a heat conducting layer 34 and lower and upper insulating layers 35*a*, 35*b* (i.e., insulating cover layers) each extending along the printed circuit substrate 11. Here, the heat conducting layer 34 has a thermal conductivity higher than those of the printed circuit substrate 11 and the insulating layers 35*a*, 35*b* of the electrically insulating sheet 33, and is for example constituted by a graphite sheet or a highly heat-conductive metal sheet. Each of the insulating layers 35*a*, 35*b* is composed of an electrically insulating resin material layer, e.g., a PET sheet.

Concretely, the insulating layers 35*a*, 35*b* of the electrically insulating sheet 33 are disposed on both sides of the heat conducting layer 34 to oppose to each other, and securely adhered to each other around the periphery of the click portion 33*a* and within the opening inner edge 34*e* of the heat conducting layer 34. On the inside of the click portion 33*a* of the electrically insulating sheet 33, the third contacting part 12 is securely retained by at least one of the insulating layers 35*a*, 35*b*. For example, as shown in FIG. 10(*a*), the lowermost insulating layer 35*a* (i.e., the lower insulating cover layer) of the electrically insulating sheet 33 forms an insulating retainer layer securely retaining the third contacting part 12 and securely adhered onto the printed circuit substrate 11, while on the other hand the uppermost insulating layer 35*b* (i.e., upper insulating cover layer) of the electrically insulating sheet 33 forms an insulating cover layer securely adhered onto the heat conducting layer 34 so as to cover the heat conducting layer 34. FIG. 10(*b*) shows a modified form of the push button switch 30, in which the uppermost insulating layer 35*b* of the electrically insulating sheet 33 forms an insulating retainer layer retaining the third contacting part 12 and fixedly connected to the printed circuit substrate 11 through the heat conducting layer 34 and the undermost insulating layer 35*a*. In this form, the undermost insulating layer 35*a* forms an insulating caver layer covering the lower side of the heat conducting layer 34 (i.e., the same side as the substrate).

As shown in FIGS. 10(*a*) and 10(*b*), the heat conducting layer 34 has an opening, for example a circular opening, around the contour of the click portion 33*a* of the electrically insulating sheet 33. The opening inner edge 34*e* of the heat conducting layer 34 is not overlapped with the contour of the circular peripheral edge portion 12*e* of the third contacting part 12, and spaced from or adjacent to each other in the surface direction of the printed circuit substrate 11 with the opening inner edge 34*e* of the heat conducting layer 34 encircling around the contour of the circular peripheral edge portion 12*e* of the third contacting part 12. This means that the electrically insulating sheet 33 has a thin portion thinner than the other portion thereof within the area where the electrically insulating sheet 33 and the center portion 12*c*, i.e., the movable contact are overlapped, and that the click portion 33*a* of the electrically insulating sheet 33 becomes sufficiently flexible.

These three layers, i.e., the insulating layers 35*a*, 35*b* and the heat conducting layer 34 are laminated and securely integrally adhered to one another so as to collectively constitute the electrically insulating sheet 33, the undermost layer portion of which is securely mounted on the printed circuit substrate 11 by adhesion or the like. On the inside of the click portion 33*a* of the electrically insulating sheet 33, the third contacting part 12 is securely retained by the undermost insulating adhesive layer not shown in the drawings. And, the third contacting part 12 is positioned above or on the first and second contacting parts 11*a*, 11*b* of the printed circuit substrate 11 with the lower edge portion of the third contacting part 12 being held in contact with the second contact 11*b* on each side of the first contact 11*a*.

The rest of the constituent elements are the same as those in the aforementioned first embodiment.

According to the present embodiment, because of the existence of the heat conducting layer 34 extending along the printed circuit substrate 11, the heat generated from the parts on the printed circuit substrate 11 is effectively transmitted in the surface direction of the printed circuit substrate 11 to efficiently heat soak the printed circuit substrate 11 in spite of the fact that a number of electronic parts are mounted on the printed circuit substrate 11. The heat from the heat generating part 19 and the like on the printed circuit substrate 11 is broadly effectively diffused in the surface direction of the printed circuit substrate 11 to efficiently radiate the heat from the heat generating part 19 and the like because the heat conducting layer 34 extends along the printed circuit substrate 11 to be close to the printed circuit substrate 11. The push button switch according to the present embodiment therefore has the same effects as in the aforesaid first embodiment.

Further, according to the present embodiment, the electrically insulating sheet 33 has a thin portion within the area where the click portion 33*a* of the electrically insulating sheet 33 is held in contact with the engaging portion 16*d* of the key sheet 16. This enables to reduce the height of the click portion 33*a* on the printed circuit substrate 11 to practically reduce the size and thickness of the electronic apparatus 1. This also makes it possible to improve the click feeling of the button portions 16*a* by means of the flexible third contract 12 having plate spring feature.

Fourth Embodiment

Figure 12A:
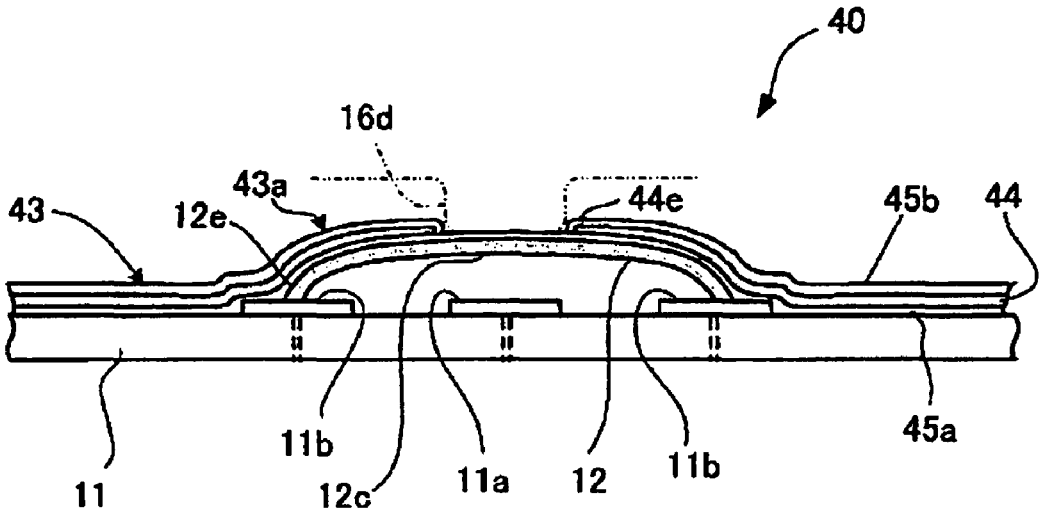
FIG. 12 are side sectional views each showing the main part of a fourth embodiment of the push button switch of the electronic apparatus according to the present invention, and include FIG. 12(*a*) showing an exemplified undermost electrically insulating retainer layer retaining the flexible second contact, and a heat conducting layer and an electrically insulating cover layer both laid on the undermost layer and having their respective opening portions each corresponding to the click portion, and FIG. 12(*b*) showing an exemplified uppermost electrically insulating layer retaining the flexible second contact, and a heat conducting layer and an electrically insulating cover layer both laid under the uppermost layer and having their respective opening portions each corresponding to the click portion.
Figure 12B:
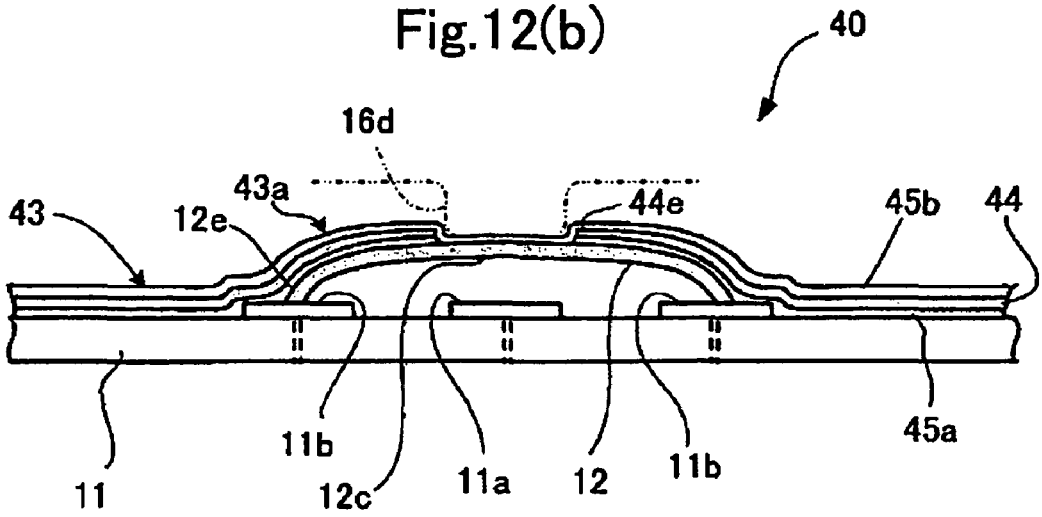
Figure 13A:
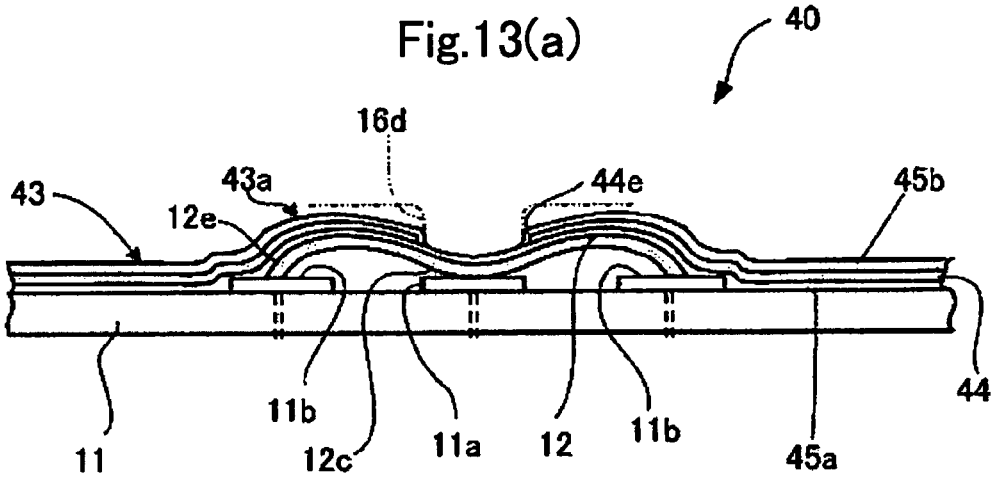
FIG. 13(*a*) and FIG. 13(*b*) are enlarged sectional views of the main parts of the push button switch respectively corresponding to FIG. 12(*a*) and FIG. 12(*b*) and each showing the depressed click portion of the push button switch.
Figure 13B:
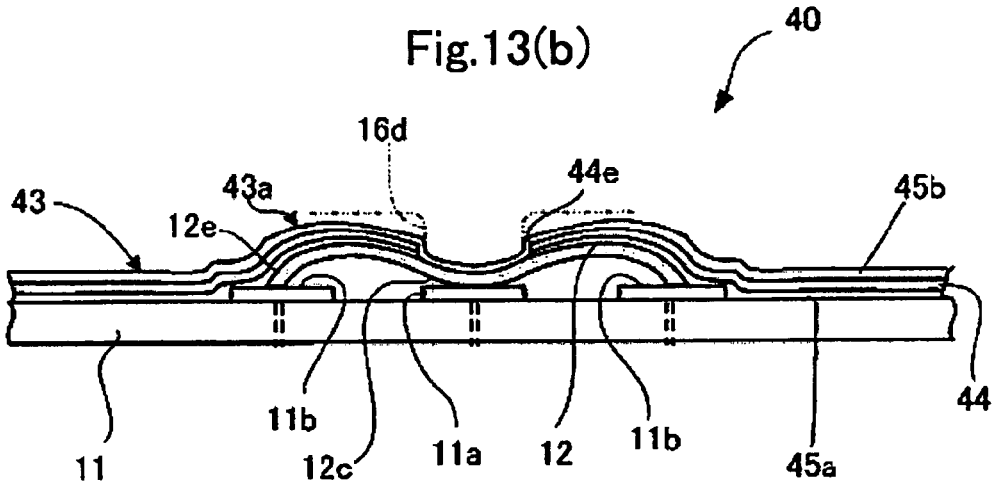

FIG. 12 and FIG. 13 in combination show a fourth embodiment of the electronic apparatus according to the present invention.

The electronic apparatus according to the present embodiment is a compact and thin portable electronic apparatus equipped with a plurality of push button switches 40 in the chassis in the same manner as in the aforementioned first embodiment. This electronic apparatus in appearance has an exterior the same as or similar to that of the conventional mobile phone shown in FIG. 15. The constituent elements the same as those in the aforementioned first embodiment bear their respective reference numerals the same as those shown in FIGS. 1 to 4, and are omitted in detailed description thereof.

As shown in FIG. 12(*a*) and FIG. 12(*b*), each of the push button switches 40 according to the present embodiment comprises, on the printed circuit substrate 11, the first contacting part 11*a* and the second contacting part 11*b* operable to be brought into electrical conduction with the first contact 11*a*, and a flexible electrically insulating sheet 43 (i.e., an electrically insulating layer) covering the upper side surface of the printed circuit substrate 11. The electrically insulating sheet 43 has a click portion 43*a* on the inside of which the first contacting part 11*a* and the second contacting part 11*b* are so disposed as to be brought into and out of electrical conduction therebetween in response to depression of the click portion 43*a* of the electrically insulating sheet 43. The printed circuit substrate 11 and the push button switch 40 are housed in the chassis 17 of the electronic apparatus 1 with a key sheet 16 additionally provided in the chassis 17.

Minutely, each of the first contacting parts 11*a* is positioned between the second contacting parts 11*b* in the surface direction of the printed circuit substrate 11, and the second contacting parts 11*b* positioned on both sides of the first contact 11*a* are held in contact with the third contacting part 12.

The center portion 12*c* of the third contacting part 12 is adapted to function as a movable contact through which the first contact 11*a* and the second contact 11*b* can be brought into electrical conduction with each other when the third contacting part 12 is depressed by the switch depression force from one of the button portions 16*a* of the key sheet 16 through the corresponding click portion 43*a* of the electrically insulating sheet 43 and the center portion 12*c* is displaced onto the first contact 11*a* as shown in FIGS. 13(*a*) and 13(*b*). The center portion 12*c* of the third contacting part 12 is further brought out of contact and electrical conduction with the first contact 11*a* and resiliently returns to the home position distant from the first contact 11*a* as shown in FIGS. 12(*a*) and 12(*b*) when the switch depression force from one of the button portions 16*a* of the key sheet 16 is released.

The electrically insulating sheet 43 includes a heat conducting layer 44 and lower and upper insulating layers 45*a*, 45*b* (i.e., insulating cover layers) each extending along the printed circuit substrate 11. Here, the heat conducting layer 44 has a thermal conductivity higher than those of the printed circuit substrate 11 and the insulating layers 45*a*, 45*b* of the electrically insulating sheet 43, and is for example constituted by a graphite sheet or a highly heat-conductive metal sheet. Each of the insulating layers 45*a*, 45*b* is composed of an electrically insulating resin material layer, e.g., a PET sheet.

As shown in FIG. 12(*a*), the undermost insulating layer 45*a* (i.e., the lower insulating cover layer) of the electrically insulating sheet 43 forms an insulating retainer layer retaining the third contacting part 12 and securely adhered onto the printed circuit substrate 11, while, on the other hand, the uppermost insulating layer 45*b* (i.e., the upper insulating cover layer) of the electrically insulating sheet 43 forms an insulating cover layer securely adhered onto the heat conducting layer 44 so as to cover and protect the heat conducting layer 44. The heat conducting layer 44 and the uppermost insulating layer 45*b* have their respective opening portions, smaller in opening diameter than those of the second embodiment, where the click portion 43*a* of the electrically insulating sheet 43 is held in contact with the engaging portion 16*d* of the key sheet 16. In other words, the electrically insulating layer 43 has a thin portion singly composed of the insulating layer 45*a* within the area where the electrically insulating sheet 43 and the center portion 12*c*, i.e., the movable contact of the third contacting part 12 are overlapped. The electrically insulating sheet 43 may be modified as shown in FIG. 12(*b*). In this modified form, the uppermost insulating layer 45*b* of the electrically insulating sheet 43 forms an insulating retainer layer retaining the third contacting part 12 and fixedly connected to the printed circuit substrate 11 through the heat conducting layer 44 and the undermost insulating layer 45*a*, while, on the other hand, the heat conducting layer 44 and the undermost insulating layer 45*a* of the electrically insulating sheet 43 have their respective opening portions within the area over which the switch depression force from the engaging portion 16*d* may be exerted.

These three layers, i.e., the insulating layers 45*a*, 45*b* and the heat conducting layer 44 are laminated and securely integrally adhered to one another so as to collectively constitute the electrically insulating sheet 43, the undermost layer portion of which is securely mounted on the printed circuit substrate 11 by adhesion or the like. On the inside of the click portion 33*a* of the electrically insulating sheet 33, the third contacting part 12 is securely retained by the undermost insulating adhesive layer not shown in the drawings, and the third contacting part 12 is positioned above or on the first and second contacting parts 11*a*, 11*b* of the printed circuit substrate 11 with the lower edge portion of the third contacting part 12 being held in contact with the second contact 11*b* on each side of the first contact 11*a*.

The rest of the constituent elements are the same as those in the aforementioned first embodiment.

According to the present embodiment, because of the existence of the heat conducting layer 44 extending along the printed circuit substrate 11, the heat generated from the parts on the printed circuit substrate 11 is effectively transmitted in the surface direction of the printed circuit substrate 11 to efficiently heat soak the printed circuit substrate 11 in spite of the fact that a number of electronic parts are mounted on the printed circuit substrate 11. The heat from the heat generating part 19 and the like on the printed circuit substrate 11 is broadly effectively diffused in the surface direction of the printed circuit substrate 11 to efficiently radiate the heat from the heat generating part 19 and the like because the heat conducting layer 44 extends along the printed circuit substrate 11 to be close to the printed circuit substrate 11. The push button switch according to the present embodiment therefore has the same effects as in the aforesaid first embodiment.

Further, according to the present embodiment, the electrically insulating sheet 43 has a thin portion within the area where the click portion 43*a* of the electrically insulating sheet 43 is held in contact with the engaging portion 16*d* of the key sheet 16. This enables to reduce the height of the click portion 43*a* on the printed circuit substrate 11 to practically reduce the size and thickness of the electronic apparatus 1.

Fifth Embodiment

Figure 14:
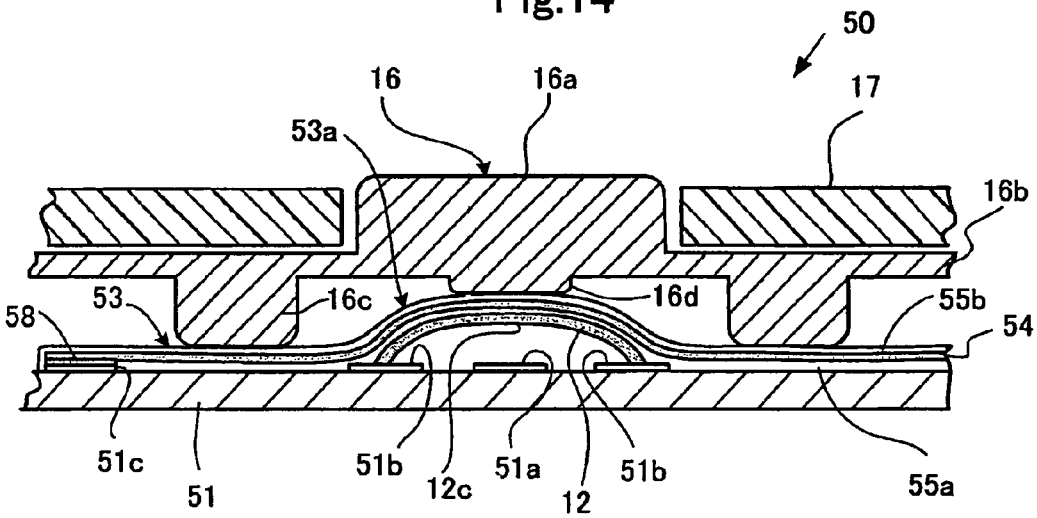
FIG. 14 is a side sectional view showing the main part of a fifth embodiment of the push button switch of the electronic apparatus according to the present invention.

FIG. 14 shows a fifth embodiment of the electronic apparatus according to the present invention.

The electronic apparatus according to the present embodiment is a compact and thin portable electronic apparatus equipped with a plurality of push button switches 50 in the chassis as in the same manner as in the aforementioned first embodiment. This electronic apparatus in appearance has an exterior the same as or similar to that of the conventional mobile phone shown in FIG. 15. The constituent elements the same as those in the aforementioned first embodiment bear their respective reference numerals the same as those shown in FIGS. 1 to 4, and are omitted in detailed description thereof.

As shown in FIG. 14, each of the push button switches 50 according to the present embodiment comprises, on a printed circuit substrate 51, a first contacting part 51*a* and a second contacting part 51*b* operable to be brought into electrical conduction with the first contacting part 51*a*, and a flexible electrically insulating sheet 53 (i.e., an electrically insulating layer) covering the upper side surface of the printed circuit substrate 51. The electrically insulating sheet 53 has a click portion 53*a* in which the first contacting part 51*a* and the second contacting part 51*b* are so disposed as to be brought into and out of electrical conduction therebetween in response to depression of the click portion 53*a* of the electrically insulating sheet 53.

The printed circuit substrate 51 and the push button switch 50 are housed in the chassis 17 of the electronic apparatus 1 with the key sheet 16 additionally provided in the chassis 17. The key sheet 16 is equipped with a plurality of button portions 16*a* (i.e., depression member) each operable to depress the click portion 53*a* of the electrically insulating sheet 53 and a flexible viscoelastic, e.g., rubber elastic sheet 16*b* on which the button portions 16*a* are mounted. The rubber elastic sheet 16*b* is provided and integrally formed on its underside with a plurality of support projection portion 16*c* projecting toward the electrically insulating sheet 53 and a plurality of engaging portions 16*d* (i.e., depression member) each engageable to the click portion 53*a* of the electrically insulating sheet 53.

To put it in concrete, the second contacting parts 51*b* on the printed circuit substrate 51 are separated from each other or collectively formed into an annular shape to have the first contact 51*a* put therebetween or therein in the surface direction (i.e., plate surface direction) of the printed circuit substrate 11. These first and second contacting parts 51*a* and 51*b* are electrically connected to an electronic circuit, not shown in the drawing, on one side or/and the other side of the printed circuit substrate 51.

Further, the second contacting parts 51*b* positioned on both sides of the first contact 51*a* in FIG. 14 are held in contact with the third contacting part 12 composed of an electrically conductive metal diaphragm and securely retained on the inside surface of the click portion 53*a* of the electrically insulating sheet 53. The center portion 12*c* of the third contacting part 12 is adapted to function as a movable contact through which the first contact 51*a* and the second contact 51*b* can be brought into electrical conduction with each other when the third contacting part 12 is depressed by the switch depression force from one of the button portions 16*a* of the key sheet 16 through the corresponding click portion 53*a* of the electrically insulating sheet 53 and the center portion 12*c* is displaced onto the first contact 51*a*. When the switch depression force is released from the one of the button portions 16*a* of the key sheet 16, the center portion 12*c* of the third contacting part 12 is brought out of contact and electrical conduction with the first contact 51*a*, and resiliently returns to the home position distant from the first contact 51*a*.

The electrically insulating sheet 53 includes a heat conducting layer 54 and lower and upper insulating layers 55*a*, 55*b* (i.e., insulating cover layers) each extending along the printed circuit substrate 51. Here, the heat conducting layer 54 has a thermal conductivity higher than those of the printed circuit substrate 51 and the insulating layers 55*a*, 55*b* of the electrically insulating sheet 53, and is for example constituted by a graphite sheet or a highly heat-conductive metal sheet or the like.

Each of the insulating layers 55*a*, 55*b* is composed of an electrically insulating resin material layer, e.g., a PET sheet. The undermost insulating layer 55*a* (i.e., the lower insulating cover layer) of the electrically insulating sheet 53 forms an insulating retainer layer retaining the third contacting part 12 and securely adhered onto the printed circuit substrate 51, while, on the other hand, the uppermost insulating layer 55*b* (i.e., the upper insulating cover layer) of the electrically insulating sheet 53 forms an insulating cover layer securely adhered onto the heat conducting layer 54 so as to cover and protect the heat conducting layer 54.

These three layers, i.e., the insulating layer 55*a*, the heat conducting layer 54 and the insulating layer 55*b* are laminated and securely integrally adhered to one another so as to collectively constitute the electrically insulating sheet 53, the undermost layer portion of which is securely mounted on the printed circuit substrate 51 by adhesion or the like. The third contacting part 12 on the inside of the click portion 53*a* of the electrically insulating sheet 53 is positioned and retained by the click portion 53*a* to be above or on the first and second contacting parts 51*a*, 51*b* with the lower edge portion of the third contacting part 12 being held in contact with the second contact 51*b* on each side of the first contact 51*a*.

The key sheet 16 is disposed on one side of the electrically insulating sheet 53 against the printed circuit substrate 51, and each of the engaging portions 16*d* on the lower side surface of the key sheet 16 is held in contact with the corresponding one of the click portions 53*a* of the electrically insulating sheet 53 at the position just below the corresponding one of the button portions 16*a*.

The heat conducting layer 54 has electrical conductivity and electrically connected through an electrical connection layer 58, made of an electrically conductive adhesive layer or the like, with a ground pattern 51*c* that is an electrically conductive land portion provided on the printed circuit substrate 51. In other words, on the externally exposed upper surface portion of the electrically insulating sheet 53, the electrically conductive heat conducting layer 54 is totally covered with the upper insulating layer 55*b*, while, on the lower side facing to the printed circuit substrate 51, the heat conducting layer 54 is electrically exposed with the electrical connection layer 58 in addition to the independently exposed third contacting part 12.

According to the present embodiment, because of the existence of the heat conducting layer 54 extending along the printed circuit substrate 51, the heat generated from the parts on the printed circuit substrate 51 is effectively transmitted in the surface direction of the printed circuit substrate 51 to efficiently heat soak the printed circuit substrate 51 in spite of the fact that a number of electronic parts are mounted on the printed circuit substrate 51. The heat from the heat generating part 19 and the like on the printed circuit substrate 51 is broadly effectively diffused in the surface direction of the printed circuit substrate 51 to efficiently radiate the heat from the heat generating part 19 and the like because the heat conducting layer 54 extends along the printed circuit substrate 51 to be close to the printed circuit substrate 51. The push button switch 50 according to the present embodiment therefore has the same effects as in the aforesaid first embodiment.

Further, according to the present embodiment, it is possible to prevent the printed circuit substrate 51 from introducing static electricity to each of the contacting parts and causing to malfunction or the like of the electronic apparatus 1 due to the static electricity, because the electrically conductive heat conducting layer 54 is electrically connected through the electrical connection layer 58 with the ground pattern 51*c* on the printed circuit substrate 51.

INDUSTRIAL APPLICABILITY

As was mentioned above, according to the present invention, effect of heat soak of the substrate having electronic parts mounted thereon can be increased by sufficient heat radiation along the surface of the substrate through the heat conducting layer extending along the substrate, and it becomes possible to broadly diffuse heat from the heat generating part on the substrate along the surface of the substrate by means of the heat conducting layer in the vicinity of the substrate, and to prevent the local heating of the chassis of the electronic apparatus. The present invention is therefore useful to various types of push button switches and electronic apparatuses, particularly to a push button switch proper for compact and thin portable electronic apparatuses to be improved in heat radiation characteristics.

The invention claimed is:

1. A push button switch, comprising: a substrate having a first contacting part and a second contacting part operable to be brought into electrical conduction with said first contacting part, and a flexible electrically insulating layer covering said substrate and having a click portion, said first contacting part and said second contacting part being disposed on the inside of said click portion so as to be brought into and out of electrical conduction therebetween in response to depression of said click portion of said electrically insulating layer, in which said electrically insulating layer includes a heat conducting layer extending along said substrate and an insulating cover layer extending along said substrate and securely adhered onto said heat conducting layer.

2. A push button switch as set forth in claim 1, in which said electrically insulating layer includes an upper insulating cover layer positioned on one side of said heat conducting layer against said substrate, and a lower insulating cover layer positioned on the other side of said heat conducting layer with said substrate, said upper insulating cover layer and said lower insulating cover layer being tacked to each other so as to cover and surround said contour of said heat conducting layer.

3. A push button switch as set forth in claim 1, in which said electrically insulating layer has a thin portion corresponding to said click portion.

4. A push button switch as set forth in claim 3, in which said heat conducting layer has an opening portion corresponding to said thin portion of said electrically insulating layer.

5. A push button switch as set forth in claim 4, in which said opening portion of said heat conducting layer is positioned within a depression area over which the depression force to said click portion of said electrically insulating layer may be exerted.

6. A push button switch as set forth in claim 4, in which said opening portion of said heat conducting layer has an inner edge allowing said insulating cover layer to form said thin portion within said click portion of said electrically insulating.

7. A push button switch as set forth in claim 4, in which said opening portion of said heat conducting layer has an inner edge encircling said click portion of said electrically insulating layer.

8. A push button switch as set forth in claim 4, in which said electrically insulating layer includes an upper insulating cover layer positioned on one side of said heat conducting layer against said substrate and a lower insulating cover layer positioned on the other side of said heat conducting layer with said substrate, either one of which has another opening portion on said click portion of said electrically insulating layer.

9. A push button switch as set forth in claim 1, in which said heat conducting layer is made of graphite.

10. A push button switch as set forth in claim 1, in which said substrate includes an electrically conductive layer, and said heat conducting layer is made up of an electrically conductive material and electrically connected with said electrically conductive layer of said substrate.

11. A push button switch as set forth in claim 1, in which said electrically insulating layer has a white or glossy surface course.

12. An electronic apparatus, comprising said push button switch as set forth in any one of claims 1-11.

* * * * *